US006533401B1

(12) United States Patent
Matsumoto et al.

(10) Patent No.: US 6,533,401 B1
(45) Date of Patent: Mar. 18, 2003

(54) LIQUID DISCHARGING METHOD, LIQUID DISCHARGE HEAD AND LIQUID DISCHARGING APPARATUS

(75) Inventors: Nobuyuki Matsumoto, Tokyo; Sadayuki Sugama, Tsukuba; Hiroyuki Ishinaga, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,381

(22) Filed: Jul. 27, 2000

(30) Foreign Application Priority Data

Jul. 27, 1999 (JP) ..... 11-212903

(51) Int. Cl.[7] ..... B41J 2/14
(52) U.S. Cl. ..... 347/65
(58) Field of Search ..... 347/63, 65, 94

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/56 |
| 4,558,333 | A | 12/1985 | Sugitani et al. | 347/65 |
| 4,723,129 | A | 2/1988 | Endo et al. | 347/56 |
| 4,740,796 | A | 4/1988 | Endo et al. | 347/56 |
| 5,278,585 | A | 1/1994 | Karz et al. | 347/65 |

FOREIGN PATENT DOCUMENTS

| | | |
|---|---|---|
| DE | 436047 | 7/1991 |
| EP | 721841 | 7/1996 |
| EP | 739738 | 10/1996 |
| EP | 811 495 A2 | 10/1997 |
| EP | 811493 | 12/1997 |
| EP | 819528 | 1/1998 |
| EP | 976561 | 2/1999 |
| EP | 982 136 A2 | 1/2000 |
| EP | 976 562 A2 | 2/2000 |
| JP | 59-123670 | 7/1984 |
| JP | 59-138461 | 8/1984 |
| JP | 60-71260 | 4/1985 |
| JP | 63-1918 | 1/1988 |
| JP | 64-24588 | 1/1989 |
| JP | 9-48127 | 2/1997 |
| JP | 9-323420 | 12/1997 |

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid discharge method through a liquid discharge head provided with a liquid flow path having a bubble generating area, in which a bubble is generated from liquid; a heater for generating heat energy to generate and grow the bubble; a discharge port which communicates to the liquid flow path and is a portion for discharging the liquid; a movable member provided in the bubble generating area, having a free end which shifts along with growth of the bubble; and a liquid flow regulating portion for regulating liquid flow in a direction opposite to the discharge port in a displacement process of the movable member and the growth of the bubble, having a step of forming space substantially closed in the liquid flow path having the bubble generating area except for the discharge port by bringing the free end of the movable member in the displacement process, close to the liquid flow regulating portion without substantially contacting each other.

20 Claims, 21 Drawing Sheets

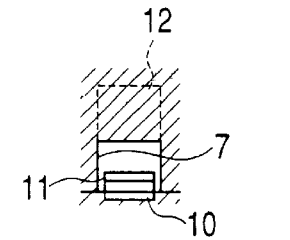
FIG. 1A2
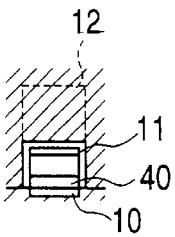
FIG. 1B2
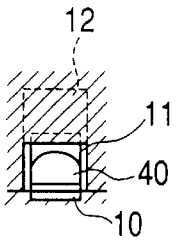
FIG. 1C2
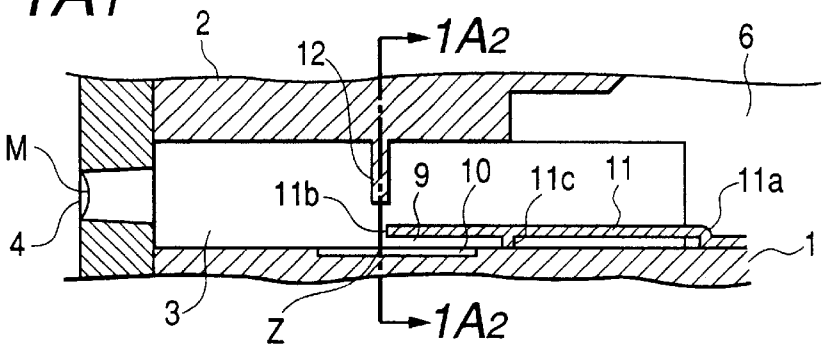
FIG. 1A1
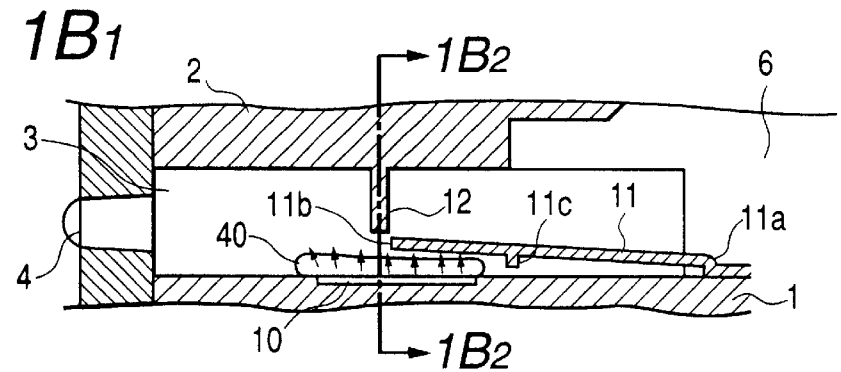
FIG. 1B1
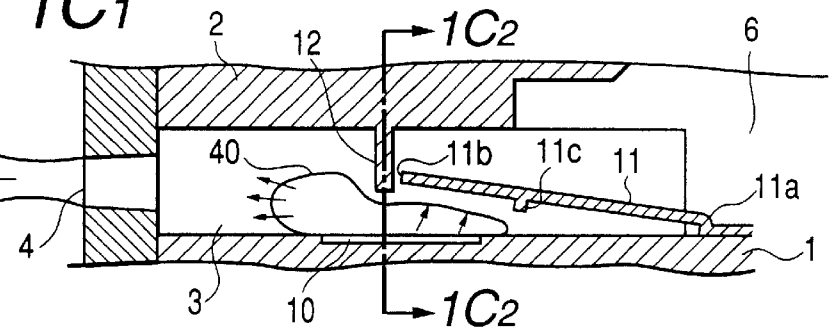
FIG. 1C1

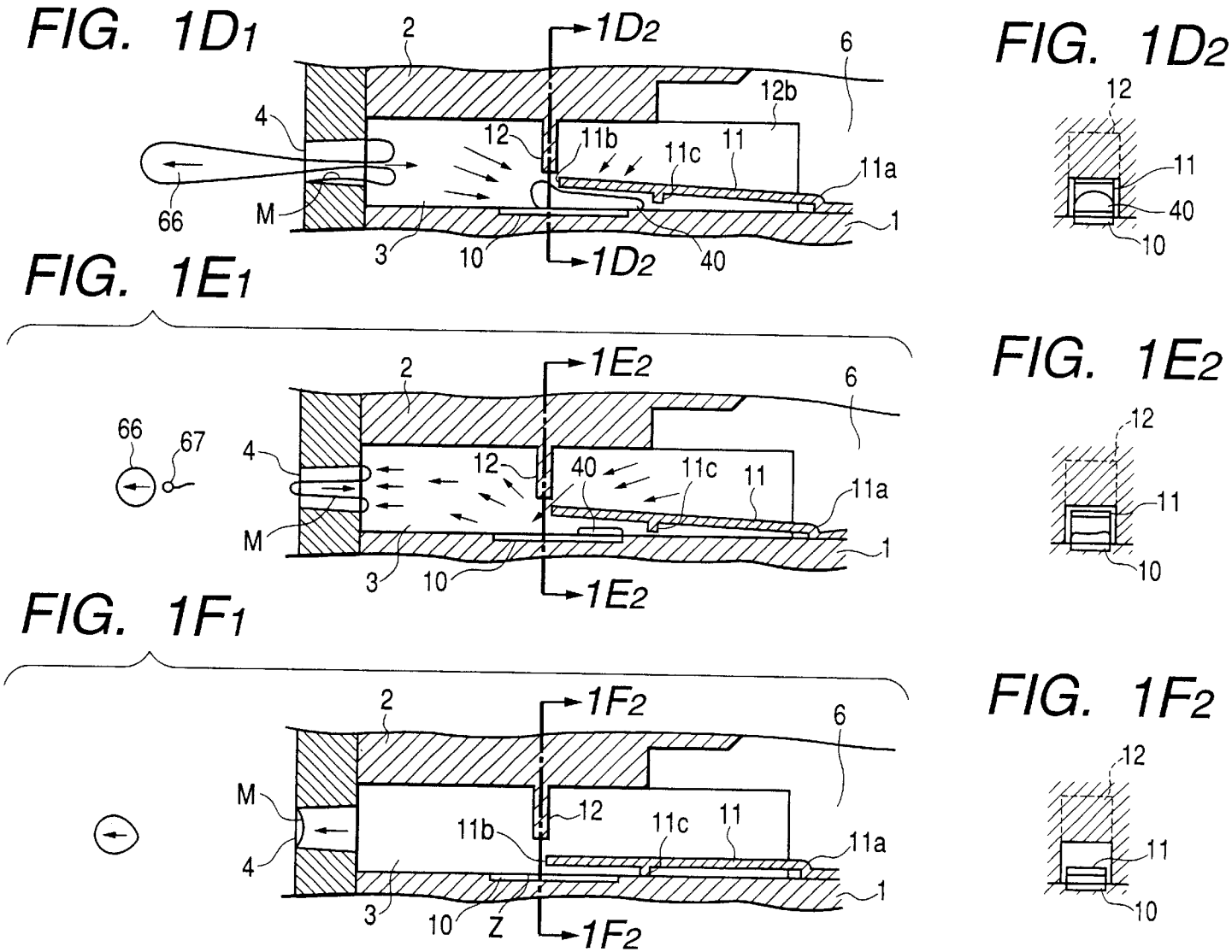
FIG. 1D1
FIG. 1D2
FIG. 1E1
FIG. 1E2
FIG. 1F1
FIG. 1F2
1D2
1E2
1F2
1
2
3
4
6
10
11
11a
11b
11c
12
12b
40
66
67
M
Z

LIQUID DISCHARGING METHOD, LIQUID DISCHARGE HEAD AND LIQUID DISCHARGING APPARATUS

BACKGROUND OF THE INVENTION

1. Field of the Invention

The present invention relates to a liquid discharging apparatus for discharging liquid by generating a bubble by the application of heat energy on the liquid, and more particularly to a liquid discharging apparatus having a movable member which displaces by taking advantage of generation of the bubble.

In this respect, "recording" in the present invention is not only to impart a significant image such as characters and patterns onto a recording medium, but also to impart a meaningless image including any other than patterns or the like.

2. Related Background Art

Conventionally, there has been known an ink jet recording method, a so-called bubble jet recording method, in which, in a recording apparatus such as printers, the bubble is generated by imparting energy such as heat to liquid ink in a flow path, and the ink is discharged through discharging ports by means of an operating force based on a sudden volume change caused by the occurrence of the bubble to cause the ink to adhere onto a recording medium for forming an image. A recording apparatus using this bubble jet recording method is generally provided, as disclosed in specification of U.S. Pat. No. 4,723,129 or the like, with discharging ports through which the ink is discharged, flow paths communicated to these discharging ports, and electrothermal transducers as energy generating means for discharging the ink provided within the flow paths.

Such a recording method has many excellent advantages that it is possible to easily obtain a recorded image with high resolution and further, a color image with a small-sized apparatus because a high-quality image can be recorded at high speed and in low noise and a head in which this recording method is performed can be at high density provided with discharging ports for discharging the ink. For this reason, this bubble jet recording method has been utilized for many office equipment such as printers, copying machines and facsimile apparatuses in recent years, and further for industrial systems such as textile printing apparatuses.

As the bubble jet technique has been utilized for products in many fields as described above, the following various requests have been further increasing in recent years.

In order to obtain a high-quality image, there are proposed driving conditions for allowing a liquid discharging method in which excellent ink based on stable occurrence of the bubble can be performed at high speed, and a method in which the shape of flow paths has been improved in order to obtain a liquid discharging head having a faster refill speed of the discharged liquid within the flow paths in view of high-speed recording.

In addition to such a head, there has been disclosed, in Japanese Patent Application Laid-Open No. 6-31918, an invention having configuration to prevent back waves (pressure toward a direction opposite to the direction toward the discharging ports), which becomes loss energy in the discharging, focusing attention on the back waves for occurring with the generation of the bubble. The invention specified in this publication is that a triangular portion of a triangular plate-shaped member is caused to oppose to a heater for generating the bubble. According to this invention, the plate-shaped member restrains the back waves temporarily and slightly. This invention, however, does not touch on correlation between the growth of the bubble and the triangular portion, but the invention includes the following problems because it has no idea thereof.

That is, according to the invention specified in the above-described publication, the heater is located at the bottom of a concave portion and cannot be linearly communicated to the discharging ports, and therefore, the shape of liquid droplets cannot be stabilized. Further, since the growth of the bubble is allowed around the vertex of the triangle, the bubble grows from one side of the triangular plate-shaped member to the entire opposite side, with the result that normal growth of the bubble in the liquid is completed as if there existed no plate-shaped members. Therefore, the existence of the plate-shaped member would have nothing to do with growing the bubble. On the contrary, since the entire plate-shaped member is enclosed with the bubble, refilling to the heater located at the concave portion causes a turbulent flow in a shrinkage state of the bubble to thereby accumulate fine bubbles within the concave portion, thus violating the principle itself in which discharging is performed based on growing the bubble.

On the other hand, EP Patent Application Laid-Open No. 436047A1 has proposed an invention in which a first valve for intercepting a relation between a discharge port-neighboring area and the bubble generating unit and a second valve for completely intercepting a relation between the bubble generating unit and an ink supply unit are caused to be alternately opened and closed (FIGS. 4 to 9 of EP436047A1). In this invention, however, since these three chambers are partitioned into two chambers each, ink following the liquid droplet becomes large trailing during discharging, and there are a considerably multiplicity of satellite dots as compared with the normal discharging system in which growth of bubble, shrinkage (contraction) and bubble disappearance are performed (it is inferred that an effect of backward movement of meniscus by bubble disappearance could not be used). During refilling, although the liquid is supplied to the bubble generating unit with the bubble disappearance no liquid can be supplied to the discharge port-neighboring area until the next expanding is generated, and therefore, variations in discharged liquid droplets are not only large, but also the discharge response frequency is very small—being not at practical level.

There have been proposed, by the present applicant, a number of inventions using a movable member (a plate-shaped member having a free end closer to the discharge port side than a support, or the like) capable of effectively contributing to discharging of liquid droplets quite unlike the above described prior art. Of these inventions, a Japanese Patent Application Laid-Open No. 9-48127 discloses an invention in which the upper limit of displacement of the movable member is regulated in order to prevent behavior of the above described movable member from being slightly confused. Also, a Japanese Patent Application Laid-Open No. 9-323420 discloses an invention in which an upstream common liquid chamber is shifted on the free end side of the movable member, that is, on the downstream side by the utilization of the advantage of the movable member to enhance the refilling ability. These inventions do not focus attention on individual elements concerning formation of the liquid droplet by the entire bubble and correlation of those elements because, as a precondition for the invention, there has been supposed a form in which the growth of the bubble is released on the discharge port side at a stroke from a state in which it is temporarily wrapped by the movable member.

As the next stage, the present applicant has disclosed, in a Japanese Patent Application Laid-Open No. 10-24588, an invention in which a part of the bubble generating area is released from the movable member, as an invention (acoustic wave) in which attention is focused on the growth of the bubble due to propagation of pressure waves as an element relating to the discharging of liquid. Even in this invention, however, no attention has been focused on individual elements concerning formation of the liquid droplet itself by the entire bubble and correlation of those elements because attention is focused only on the growth of the bubble when the liquid is discharged.

Although it is known that the front portion (edge shooter type) of the bubble due to conventionally-known film boiling greatly affect the discharging, no one has focused attention on causing this portion to more efficiently contribute to formation of the discharged liquid droplet, but the present inventors have earnestly studied to elucidate these technical problems.

In such a study process, in a movable member having a free end capable of displacing with growth of the bubble, there was a case where the bubble go round from the tip end side of the movable member under a certain condition in the displacement process. As its details, the following phenomenon was confirmed in the technical analysis of the invention.

More specifically, in a process of growth of the bubble for discharging liquid droplets, and upward displacement of the movable member brought about by the growth of the bubble, the displacement of the movable member cannot catch up with the growth of the bubble, but the grown a bubble is going to go on to the upper surface of the movable member. Under a certain condition, for example, in the case where the liquid supply-side flow path resistance is very low and the liquid is prone to move in that direction, it was observed that the bubble go round to the rear of nozzle flow path along with the movement of the liquid to the rear of nozzle flow path caused by displacement of the movable member.

When a liquid flowing force to the rear of nozzle flow path is produced in the displacement process of the movable member, an effect of the movable member of efficiently directing the discharging energy caused by the growth of the bubble toward the discharge port may be reduced.

Thus, the present inventors have newly found, in the nozzle flow path for a liquid discharging head using a movable member having a free end, a liquid flow to the rear of the flow path in a process of valve displacement, and configuration of the flow path to prevent the bubble from going round to the rear of the flow path due to the liquid flow, whereby the discharging efficiency forward of the nozzles is improved, and meniscus return and early stabilization of the filling liquid during refilling are performed.

SUMMARY OF THE INVENTION

The present invention obtained in such study process as described above is characterized in that, there is provided a liquid discharge method through a liquid discharge head provided with a liquid flow path having a bubble generating area, in which a bubble is generated from liquid; a heater for generating heat energy to generate and grow the bubble; a discharge port which communicates to the liquid flow path and is a portion for discharging the liquid; a movable member provided in the bubble generating area, having a free end which shifts along with growth of the bubble; and a liquid flow regulating portion for regulating liquid flow in a direction opposite to the discharge port in a displacement process of the movable member and the growth of the bubble, having a step of forming space substantially closed in the liquid flow path having the bubble generating area except for the discharge port by bringing the free end of the movable member in the displacement process, close to the liquid flow regulating portion without substantially contacting each other.

The above described method is characterized in that, in a process in which the free end of the movable member shifts, the liquid flow in a direction opposite to the discharge port is sheared when the free end is passing through the vicinity of the liquid flow regulating portion.

Further, the method is characterized by having a process in which the bubble shrinks in a state where the closed space is formed.

The method is characterized in that, in the process in which the bubble shrinks, the greater part of the liquid which moves along with the shrinkage of the bubble is directed toward the upstream side from the discharge port and meniscus is suddenly drawn into the discharge port.

Further, the method is characterized in that the movable member is spaced apart from the liquid flow regulating portion along with the shrinkage of the bubble, whereby a liquid flow toward the downstream side facing the discharge port is caused in the bubble generating area to thereby suddenly brake the meniscus to be drawn in.

Also, according to the present invention, there is provided a liquid discharge head having: a liquid flow path having a bubble generating area, in which a bubble is generated from liquid; a heater for generating heat energy to generate and grow the bubble; a discharge port which communicates to the liquid flow path and is a portion for discharging the liquid; a movable member provided in the bubble generating area, having a free end which shifts along with the growth of the bubble; and a liquid flow regulating portion for regulating liquid flow in a direction opposite to the discharge port in the displacement process of the movable member and the growth of the bubble, in which the free end of the movable member in the displacement process and the liquid flow regulating portion are brought close to each other without actually bringing them into contact with each other, whereby the liquid flow path having the bubble generating area becomes space substantially closed except for the discharge port, and wherein there are arranged the movable member and the liquid flow regulating portion such that a bubble at the maximum growth does not intercept the interior of the space with reference to the fluid flow.

The above described head is characterized in that the liquid flow regulating portion is provided in the vicinity of the discharge port side of the displacement area of the free end of the movable member.

Further, the liquid discharge head is characterized in that there has been provided a displacement regulating unit for regulating displacement of the movable member after the formation of the closed space. This enables the refilling property to be enhanced by restraining the movement of the liquid to the upstream side after the formation of the closed space.

Further, the liquid discharge head is characterized in that there has been provided a side regulating unit, at least one portion of which substantially comes into contact with both side edges of the movable member in the displacement process, for regulating a bubble generated from the bubble generating area. This enables, even if a clearance between the side walls of the liquid flow path and the movable member is set loose, the liquid flow from the clearance to the upstream side and the growth of a bubble to be restrained.

Further, the liquid flow regulating portion is characterized in that it is located closer to the discharge port side than the free end of the movable member, and, when viewed from the discharge port, the free end of the movable member in the displacement process is covered and the liquid flow regulating portion is kept at such a distance as not to bring it into contact with the free end.

Further, the liquid discharge head is characterized in that, in the process in which the free end of the movable member shifts, the locus portion of the free end when the free end is passing through the vicinity of the liquid flow regulating portion is narrow space. This causes the liquid flow on the upstream side due to upward displacement of the movable member to become faster, and therefore, the displacement speed of the movable member is also made faster.

Further, the upstream-side portion of the liquid flow regulating portion is characterized by having a tapered configuration which tapers downwards from the flow path ceiling. This enables the flow path resistance during refilling from the upstream side to be reduced. Further, since the width of the liquid flow regulating portion in the flow path direction can be reduced, it is possible to secure a large flow path volume on the discharge port side with the liquid flow regulating portion as the border, which is useful to discharge large liquid droplets.

Further, the movable member is characterized by having a protruded portion which protrudes from the surface of the movable member on the heater side in the vicinity of the bubble generating area. This enables pressure waves when the bubble is generated not to affect the upstream side as far as possible.

According to the configuration described above, since it is possible to effectively take advantage of the flow of the liquid in the vicinity of the discharge port caused by the growth of the bubble and start of bubble disappearance for formation of liquid droplets peculiar to the ink jet, and to reduce the amount of backward movement of meniscus, time required for returning of the meniscus can be greatly shortened, and the dependence characteristic on response frequency can be improved. Particularly, due to the position of the liquid flow regulating portion relative to the movable member, the liquid flow on the upstream side and the growth of the bubble, which bring a minus effect to the refilling property, are intercepted smoothly and quickly without bringing the movable member in the displacement process into contact to thereby substantially make the liquid flow path having the bubble generating area into substantially closed space, and thus the discharging energy due to the growth of the bubble can be effectively directed toward the discharge port.

As regards the other effects of the present invention, they will be obvious from the description of each embodiment.

In this respect, "upstream" and "downstream" used in the description of the present invention are represented as expression concerning a direction of flow of the liquid from the supply source thereof toward the discharge port through the bubble generating area (or movable member), or the direction in this configuration.

Also, "downstream side" concerning the bubble itself means the downstream side concerning the above described direction of flow or the direction in the above described configuration with respect to the center of the bubble, or a bubble which is generated in an area on the downstream side of the center of area of the heater.

A "substantially contact" between the movable member and the side regulating unit, which is expressed in the present invention, does not always mean that the movable member and the side regulating unit are brought into tight contact with each other, but also includes that the movable member comes unlimitedly close to the side regulating unit.

BRIEF DESCRIPTION OF THE DRAWINGS

FIGS. 1A1, 1B1, 1C1, 1D1, 1E1 and 1F1 and FIGS. 1A2, 1B2, 1C2, 1D2, 1E2 and 1F2 are sectional views showing a liquid discharge head according to a first embodiment of the present invention, and showing characteristic phenomena within a liquid flow path divided into six processes;

FIG. 17A shows the liquid discharge head with a protective film, and FIG. 17B shows the liquid discharge head without any protective film;

DETAILED DESCRIPTION OF THE PREFERRED EMBODIMENTS

Figure 2A:
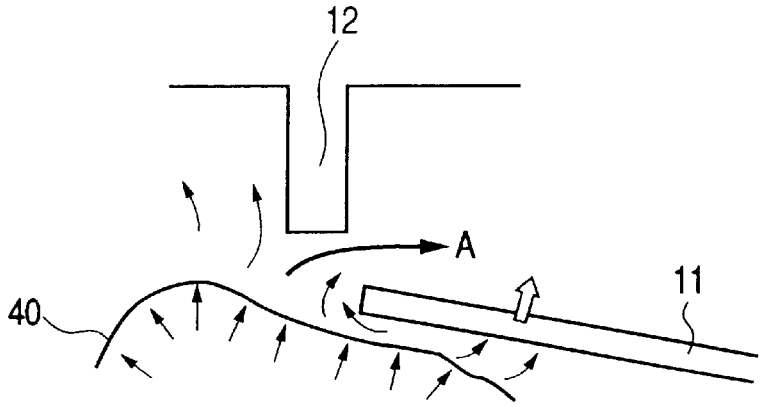
FIGS. 2A, 2B and 2C are explanatory views for illustrating a mechanism for regulating the liquid flow using a liquid flow regulating portion and a movable member in the embodiment shown in FIG. 1.

Hereinafter, the description will be made of embodiments according to the present invention.

(First Embodiment)

FIGS. 1A1 to 1F1 and FIGS. 1A2 to 1F2 are sectional views showing a liquid discharge head according to a first embodiment of the present invention, and showing characteristic phenomena within a liquid flow path divided into six processes. In particular, FIGS. 1A1 to 1F1 are sectional views obtained by cutting in a direction along a flow path, and FIGS. 1A2 to 1F2 are sectional views taken on lines 1A2—1A2, 1B2—1B2, 1C2—1C2, 1D2—1D2, 1E2—1E2 and 1F2—1F2 corresponding to FIGS. 1A1 to 1F1, respectively.

First, the description will be made of the configuration.

In a liquid discharge head having the embodiment shown in FIGS. 1A1 to 1F1, an element substrate 1 and a ceiling plate 2 are fixed in a stacked state, and a flow path 3 is provided between both plates 1 and 2. The flow path 3 is enclosed with the element substrate 1, side walls 7 and the ceiling plate (opposite plate) 2, having a long and narrow shape, and one recording head is provided with a multiplicity of flow paths 3. There is provided a common liquid chamber 6 having a large capacity on the upstream side of these multiplicity of flow paths 3 so as to communicate to all of them. In other words, the single common liquid chamber 6 is branched to the multiplicity of flow paths 3. A symbol M designates meniscus to be formed by the discharging liquid, and the meniscus M is well-balanced near the discharge port 4 with an internal pressure of the common liquid chamber 6, which is normally negative pressure, by means of a capillary force which is caused by the discharge port 4 and the inner walls of the flow path 3 communicating thereto. The liquid chamber height of the common liquid chamber 6 is much higher than the flow path height of the flow path 3. Further, correspondingly to the multiplicity of flow paths 3, the element substrate 1 is mounted with heaters (bubble generating means) 10 such as electrothermal transducers and movable members 11.

In a neighboring area of a contact surface between the heating member (heater) 10 and the discharging liquid, there exists a bubble generating area 9 in which the heater 10 is suddenly heated to foam the discharging liquid. In the flow path 3 having this bubble generating area 9, at least one portion of the movable member 11 is arranged to oppose to the heater 10.

The movable member 11 is cantilever beam-shaped with one end supported, is fixed to the element substrate 1 on the upstream side (right side of FIG. 1A1) of ink flow, and is vertically movable with respect to the element substrate 1 on the downstream side (left side of FIG. 1A1) of a support 11*a*. The movable member 11 is located in parallel to the element substrate 1 while a slight gap is maintained between the element substrate 1 and the movable member 11 in an initial state shown in FIG. 1A1.

In this embodiment, the movable member 11 is arranged in such a manner that a free end 11*b* is located at a substantially central area of the heater 10 in order to restrain growth of nearly half of the bubble on the upstream side, and, in the upper part of the immediately preceding space of the free end 11*b* of this movable member 11, there is provided a liquid flow regulating portion 12 for regulating the liquid flow in a direction that forms the flow path 3, so as to intercept the liquid flow toward the upstream side (to the rear) of the liquid path 3 in the displacement process of the movable member 11 caused by the growth of the bubble, and the growth on the upstream side of the flow path 3 of the bubble which goes around the free end 11*b* of the movable member 11 caused by the liquid flow. More specifically, the liquid flow regulating portion 12 is located closer to the discharge port 4 side than the free end 11*b* of the movable member 11, and, when the common liquid chamber 6 side is viewed from the discharge port 4, the liquid flow regulating portion 12 covers the free end 11*b* of the movable member 11 under displacement and is kept at such a distance as not to bring it into contact with the free end 11*b*. The liquid flow regulating portion 12 is, in a process in which the free end 11*b* of the movable member 11 shifts, located so as to shear the liquid flow toward the upstream side of the flow path 3 when the free end 11*b* is passing through near the side surface of the liquid flow regulating member 12 on the upstream side. In other words, the liquid flow regulating portion is provided in the vicinity of the discharge port side in the displacement area of the free end of the movable member.

The ceiling on the common liquid chamber 6 side is shaped to suddenly rise with the liquid flow regulating portion 12 as the border. In the case where there is no movable member 11 with this configuration, it is difficult to direct pressure to be used for discharging toward the discharge port 4 side because the fluid resistance in the bubble generating area 9 on the downstream side becomes lower than that on the upstream side. In this embodiment, however, since the movement of the bubble toward the upstream side of the bubble generating area 9 is substantially intercepted by the movable member 11 at the formation of the bubble, the pressure used for discharging is positively directed toward the discharge port 4 side, and since the fluid resistance in the bubble generating area 9 on the upstream side is low at the time of ink supply, the ink is to be quickly supplied to the bubble generating area 9.

With the above described configuration, growth components of the bubble toward the downstream side are not equal to growth components of the bubble toward the upstream side, but the growth components toward the upstream side become fewer, and the movement of the liquid toward the upstream side is restrained. Since the flow of liquid toward the upstream side is restrained, an amount of backward movement of meniscus after discharging is reduced, and an amount of protrusion of the meniscus from the orifice surface during refilling is also reduced by that amount. Therefore, the meniscus vibration will be restrained, resulting in stable discharging at all driving frequencies from low frequency to high frequency.

Figure 21:
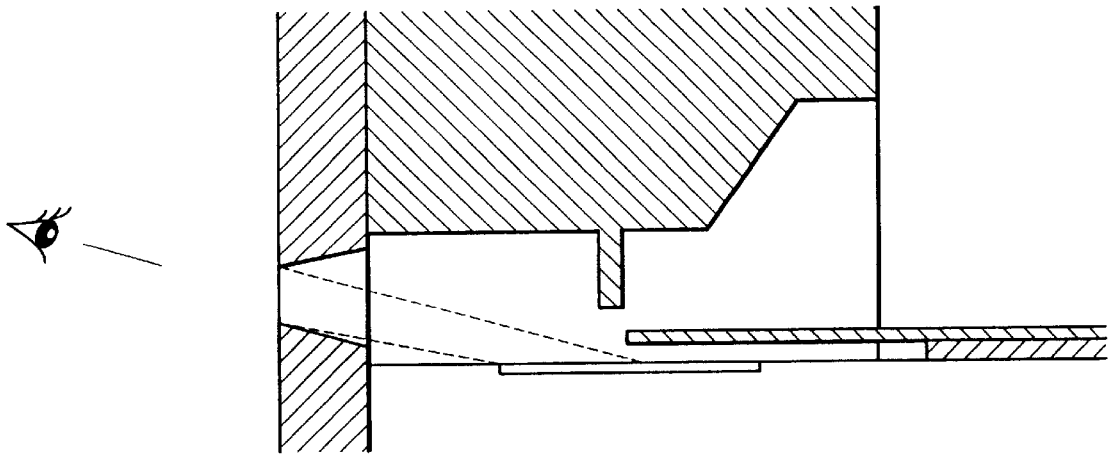
FIG. 21 is an explanatory sectional view for explaining "linear communicated state".

In this respect, in this embodiment, a liquid flow between the portion of the bubble on the downstream side and the discharge port is in a "linearly-communicated state", in which straight flow path configuration is maintained. It is more preferable that a propagation direction of pressure waves which are generated when the bubble are produced, a flowing direction of the liquid caused thereby, and the discharging direction are linearly aligned. It is desirable to form an ideal state in which the discharging state such as a discharging direction and a discharging speed of a discharging droplet 66 is stabilized at a very high level. According to the present invention, as a definition to accomplish or approximate this ideal state, the discharge port 4, the heater 10 and the discharge port side (downstream side) of the heater, which particularly affects the discharge port side of the bubble, can be constructed to be directly connected in a straight line. This is a state in which, if there is no liquid within the flow path, the heater, and particularly the downstream side thereof could be observed as viewed from the outside of the discharge port (See FIG. 21).

Also, in this embodiment, in proximity to the bubble generating area 9, the movable member 11 is provided with a protruded portion 11*c* (hereinafter, referred to as "lower protruded portion" simply) which protrudes on the substrate 1 side. This lower protruded portion 11*c* is used to restrain growth of a bubble, which is generated in the bubble generating area 9, toward the rear (upstream side), and the provision of this lower protruded portion 11*c* reduces the backward growth of the bubble. Thus, this lower protruded portion 11*c* can contribute to improved discharging energy by restraining the backward growth of the bubble.

As a position whereat the lower protruded portion 11*c* is provided, it is preferably provided at a position at least apart from a stepped portion around the heater 10 because the lower protruded portion 11*c* may abut against the substrate 1 when the movable member 11 shifts on the substrate 1 side. Concretely, it is preferably apart from an effective foaming area by 5 $\mu$m or more. Since when it is located excessively far from the bubble generating area, the effect of restraining the backward growth of the bubble cannot be exhibited, it is preferably provided within a distance of substantially half the heater length from the effective foaming area of the heater 10. More specifically, in this embodiment, it is about 45 $\mu$m, preferably within 30 $\mu$m, and more preferably 20 $\mu$m or less.

The height of the lower protruded portion 11*c* is nearly equal to or less than the distance between the movable member 11 and the element substrate 1, and in this embodiment, there is a slight clearance between the tip end of the lower protruded portion 11*c* and the element substrate 1.

By this lower protruded portion 11*c*, a bubble, which has been generated in the bubble generating area 9, is restrained from growing between the movable member 11 and the element substrate 1 in the upstream direction, and the liquid moving in the upstream direction becomes less, with the result that the refilling can be further improved.

Next, the detailed description will be made of a discharging operation of a liquid discharge head according to this embodiment.

FIG. 1A1 shows a state before energy such as electrical energy is applied to the heater 10, or a state before the heater generates heat. It is important here that the width of the movable member is sufficiently smaller than the width of the flow path and a clearance between the movable member and the flow path walls is secured, and that there is provided a liquid flow regulating portion 12 which performs early interception of the liquid flow toward the upstream side (to the rear) of the liquid path 3 in the displacement process of the movable member 11 caused by the growth of the bubble, and which performs restraint of the growth, on the upstream side of the flow path 3, of the bubble which goes around the free end 11*b* of the movable member 11 caused by the liquid flow. In other words, when the free end 11*b* of the movable member 11 and the liquid flow regulating portion 12 become positioned mutually close during upward displacement of the movable member 11, the liquid flow between the upper surface of the movable member 11 and the liquid flow regulating member 12 is sheared, and the movement of the liquid in the bubble generating area 9 toward the upstream side is restrained.

FIG. 1B1 shows a state in which a portion of the liquid which fills the bubble generating area 9 is heated by the heater 10 and a bubble 40 caused by film boiling starts to bubble.

At this time, pressure waves based on the occurrence of the bubble 40 caused by film boiling propagate within the flow path 3, whereby the liquid moves to the downstream side and the upstream side with the central area of the bubble generating area 9 as the border, and, on the upstream side, the flow of the liquid caused by the growth of the bubble 40 starts to shift the movable member 11.

FIG. 1C1 shows a state in which a portion of the liquid which fills the bubble generating area 9 is heated by the heater 10 and a bubble 40 caused by film boiling has grown at the substantially maximum. At this time, pressure waves based on the occurrence of the bubble 40 caused by film boiling further propagate, whereby, on the upstream side of the bubble generating area 9, the movable member 11 shifts until the free end 11*b* thereof is arranged in the vicinity of one surface (rear surface), on the upstream side, of the liquid flow regulating portion 12, and, on the downstream side, a discharge droplet 66 is being discharged through the discharge port 4. When the movable member 11 shifts to the position shown in FIG. 1C1, the movement of the liquid in the upstream direction is greatly limited there. In other words, at this position, the liquid flow regulating portion 12, the flow path side walls 7, the movable member 11 and a support 11*a* bring the amount of liquid, which enters the upstream side area, to substantially naught. This prevents an inverted flow and pressure vibration of the liquid in a supply path system for inhibiting high-speed refilling to be described later.

Figure 2B:
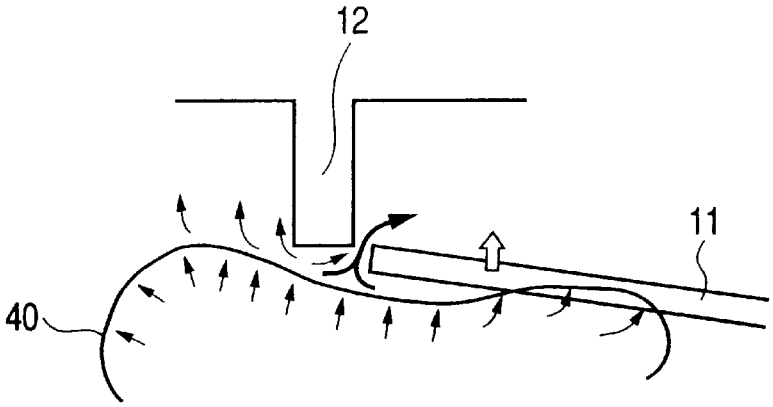
Figure 2C:
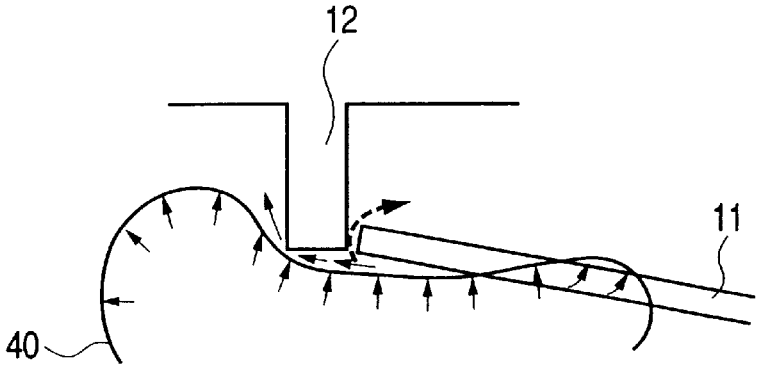

With reference to FIGS. 2A to 2C, the detailed description will be further made of the mechanism for regulating the liquid flow using the liquid flow regulating portion 12 and the movable member 11 explained now. First, as shown in FIG. 2A, the growth of the bubble 40 shifts the movable member 11, and as it moves toward the liquid flow regulating portion 12, such flow-in as liquid flow A takes place toward the upstream side (supply side) of the movable member 11. Since, however, the free end 11*b* is located upstream of the liquid flow A, the movable member 11 itself is not subjected to flowing resistance, but the shifting operation of the movable member 11 is hardly restrained. Particularly, since the liquid flow regulating portion 12 is not opposed to the movable member 11, the movable member 11 can continue to shift while the state of the liquid flow A remains, and smoothly passes through near the surface (rear surface) of the liquid flow regulating portion 12 on the upstream side. Since the presence of the liquid flow regulating portion 12 provides the locus portion of the free end 11*b* of the movable member 11 with narrow space at the time of this passage, the flow velocity of the liquid flow A is made faster, the flowing resistance is made lower, and the upward displacement speed of the movable member 11 is also made faster. Thus, at a point of time whereat the free end 11*b* of the movable member 11 shifted has been arranged in the vicinity of the surface (rear surface) of the liquid flow regulating portion 12 on the upstream side, the liquid path 3 having the bubble generating area 9 completes substantial closed space except for the discharge port 4 by means of the movable member 11 and the liquid flow regulating portion 12. For this reason, the liquid moving force within this space is almost all directed toward the discharge port side to increase the discharging force, and the movement of liquid toward the supply side (upstream side), which provides a minus effect to the refilling property, is almost eliminated (See FIG. 2C).

FIG. 1D1 shows a state in which negative pressure within the bubble overcomes the movement of liquid toward the downstream side within the liquid flow path after the above described film boiling to start shrinkage of the bubble 40. At this point of time, the flow path 3 having the bubble generating area 9 is substantially closed space except for the discharge port 4 because of the closely-positioned state between the movable member 11 shifted and the liquid flow regulating portion 12 as the entire liquid flow path. Therefore, shrinkage energy of the bubble 40 strongly works as a force for moving the liquid near the discharge port 4 in the upstream direction in balance as a whole. Therefore, the meniscus M is greatly drawn into the flow path 3 from the discharge port 4 at this point of time to quickly cut off a liquid column connected to the discharged liquid droplet 66 with a strong force. As a result, as shown in FIG. 1E1, the liquid droplet remained in the outside of the discharge port 4, that is, satellite (sub-droplet) 67 becomes fewer.

FIG. 1E1 shows a state in which a bubble disappearing process has been substantially completed and the discharged liquid droplet 66 has been separated from the meniscus M. When the movable member 11 shifts downward along with the shrinkage of the bubble and the closely-positioned state between the movable member 11 and the liquid flow regulating portion 12 is started to be released, the flow toward the downstream direction caused by the downward displacement of the movable member 11 suddenly flows into the flow path 3 through the liquid flow regulating portion 12 in a large flow because of low flow path resistance on the common liquid chamber 6 side. In this manner, the liquid on the liquid chamber side is guided into the flow path by these operations. The liquid guided into the flow path passes through between the liquid flow regulating portion 12 and the movable member 11 shifted downward as it is, flows into the downstream side of the heater 10, and operates to accelerate bubble disappearance of the bubble 40 which has not yet been disappeared. The flow of this liquid further flows toward the discharge port after assists in bubble disappearing, assists in returning the meniscus and improves the refilling speed.

The above described flow-in to the flow path 3 through a portion between the movable member 11 and the liquid flow regulating portion 12 increases the flow velocity on the wall surface on the ceiling plate 2 side, and therefore, there are very few residuals such as fine the bubble in this portion, which contributes to the stability of discharging.

Further, since a cavitation occurring point due to bubble disappearance is also shifted on the downstream side of the bubble generating area 9, damage to the heater will be reduced. Since scorch adhered to the heater in this area will be also reduced by the same phenomenon at the same time, the discharging stability is improved.

FIG. 1F1 shows a state in which the state of FIG. 1E1 further advances and the satellite 67 is taken into the discharged droplet 66. This coalescence of the discharged droplet 66 and the satellite 67 is not a phenomenon which always takes place for each discharge even in other embodiments, but there are cases where it takes place and where it does not depending upon the conditions. If, however, the amount of satellite is at least reduced or eliminated, shot positions of main droplets and satellite dots will rarely deviate on the recording medium, thus making it possible to improve the printing quality and to reduce detrimental effects such as contamination of the printing medium or the interior of the recording apparatus with ink mist, or the like.

(Second Embodiment)

Figure 3A:
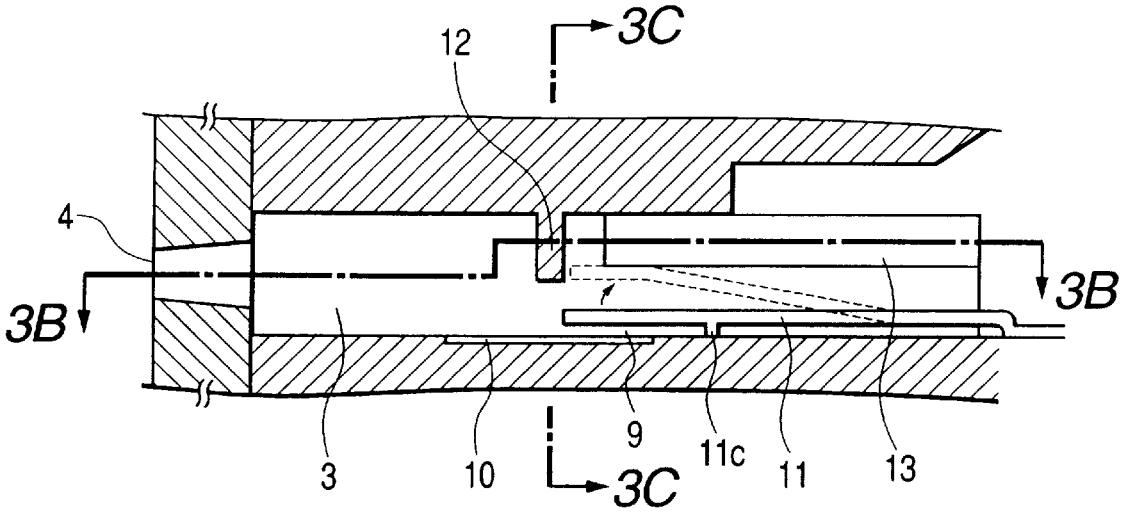
FIGS. 3A, 3B and 3C are sectional views showing a liquid discharge head according to a second embodiment of the present invention.
Figure 3B:
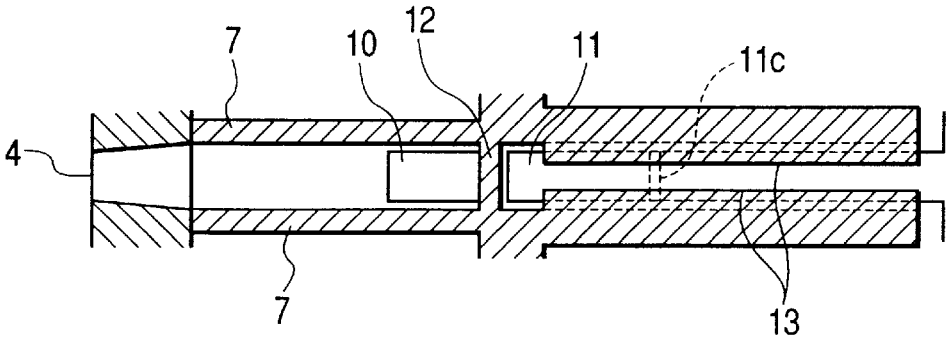
Figure 3C:
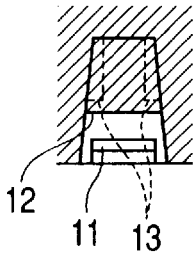

FIGS. 3A to 3C are sectional views showing a liquid discharge head according to a second embodiment of the present invention. In particular, FIG. 3A is a sectional views obtained by cutting in a direction along a flow path, FIG. 3B is a sectional views taken on line 3B—3B of FIG. 3A, and FIG. 3C is a sectional views taken on line 3C—3C of FIG. 3A. In FIGS. 3A to 3C, components identical to those in FIGS. 1A1 to 1F1 are designated by the identical reference numerals, and description of the identical components will be omitted.

This embodiment is, in addition to a configuration of the first embodiment, constructed such that a side wall 7 of the flow path 3 upstream of the liquid flow regulating portion 12 is provided, as shown in FIGS. 3A to 3C, with a side stopper 13, against which the upper surface of side edge of the movable member 11 abuts during upward displacement, and that a clearance between the movable member 11 and the flow path wall 7 is intercepted during displacement of the movable member 11.

The height of the abutment surface between the side stopper 13 and the movable member 11 is preferably determined in such a manner that the movable member 11 shifted is located at a position whereat it abuts after it passes through in the vicinity of the surface (rear surface) of the liquid flow regulating portion 12 on the upstream side.

With such configuration, although the clearance between the side stopper 13 and the movable member 11 is large immediately after heat evolution of the heater 10, the clearance becomes narrower as the movable member 11 shifts along with bubble generation caused by film boiling. When the clearance is narrow in this manner, the liquid flow on the side upstream of the bubble generating area 9, that is, toward the common liquid chamber 6 side, and passing-through of the the bubble by the liquid flow are considerably regulated. With the movable member 11 as the border, a high difference in pressure takes place between the bubble generating area side and the common liquid chamber side, and the movable member 11 is pressed by the side stopper 13 so as to be brought into tight contact. Therefore, since adherence between the movable member 11 and the side stopper 13 is increased, the liquid and the bubble will not leak from this clearance portion even if the clearance between the movable member 11 and the flow path wall is sufficiently provided. This configuration increases closeness of the bubble generating area against the common liquid chamber side, thus reducing loss of the discharging force by leakage of the liquid and the bubble into the common liquid chamber side.

In this respect, in the configuration shown in FIGS. 3A to 3C, the side stopper 13 is provided from the ceiling of the flow path 3, but the present invention is not limited thereto, but the side stopper 13 may be provided only for the side wall 7 of the flow path 3, and the shape of the side stopper 13 is not restricted so long as the upper surface of side edge of the movable member 11 during upward replacement abuts.

(Third Embodiment)

Figure 4A:
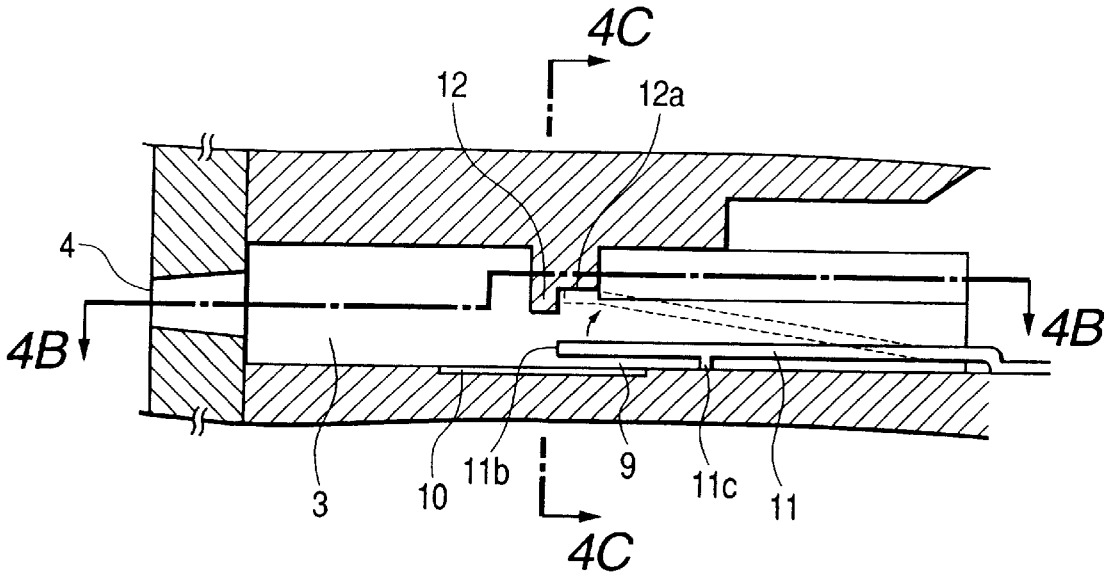
FIGS. 4A, 4B and 4C are sectional views showing a liquid discharge head according to a third embodiment of the present invention.
Figure 4B:
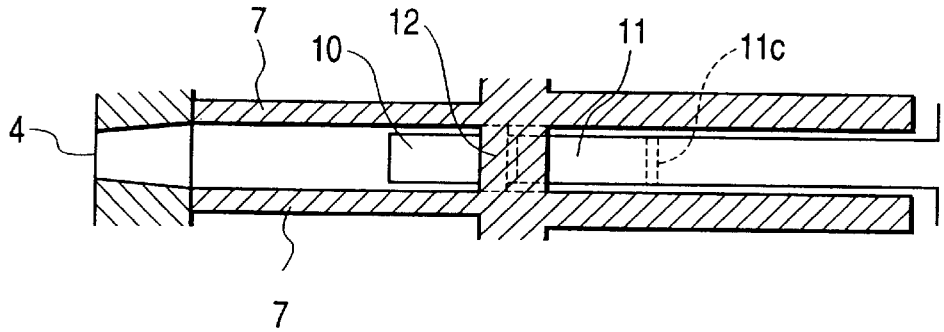
Figure 4C:
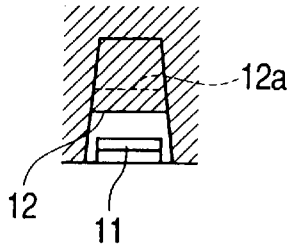

FIGS. 4A to 4C are sectional views showing a liquid discharge head according to a third embodiment of the present invention. In particular, FIG. 4A is a sectional views obtained by cutting in a direction along a flow path, FIG. 4B is a sectional views taken on line 4B—4B of FIG. 4A, and FIG. 4C is a sectional views taken on line 4C—4C of FIG. 4A. In FIGS. 4A to 4C, components identical to those in FIGS. 1A1 to 1F1 are designated by the identical reference numerals, and description of the identical components will be omitted.

This embodiment is, in addition to the configuration of the first embodiment, constructed such that an upstream-side portion of the liquid flow regulating portion 12 is provided, as shown in FIGS. 4A to 4C, with a displacement regulating unit 12*a*, against which the free end 11*b* of the movable member 11 during upward displacement abuts, and the displacement of the movable member 11 is regulated after the free end 11*b* of the movable member 11 passes in the vicinity of the surface of the liquid flow regulating portion 12 on the upstream side. The abutment surface between the displacement regulating unit 12*a* and the movable member 11 is, naturally, located higher than the tip end (lower end) of the liquid flow regulating portion 12 (near the flow path ceiling).

With such configuration, it is possible to quickly regulate the liquid flow toward the upstream side (to the rear) due to upward displacement of the movable member 11, and to improve the refilling property because the displacement of the movable member 11 is regulated after the free end 11*b* of the movable member 11 passes in the vicinity of the surface of the liquid flow regulating portion 12 on the upstream side.

(Fourth Embodiment)

Figure 5A:
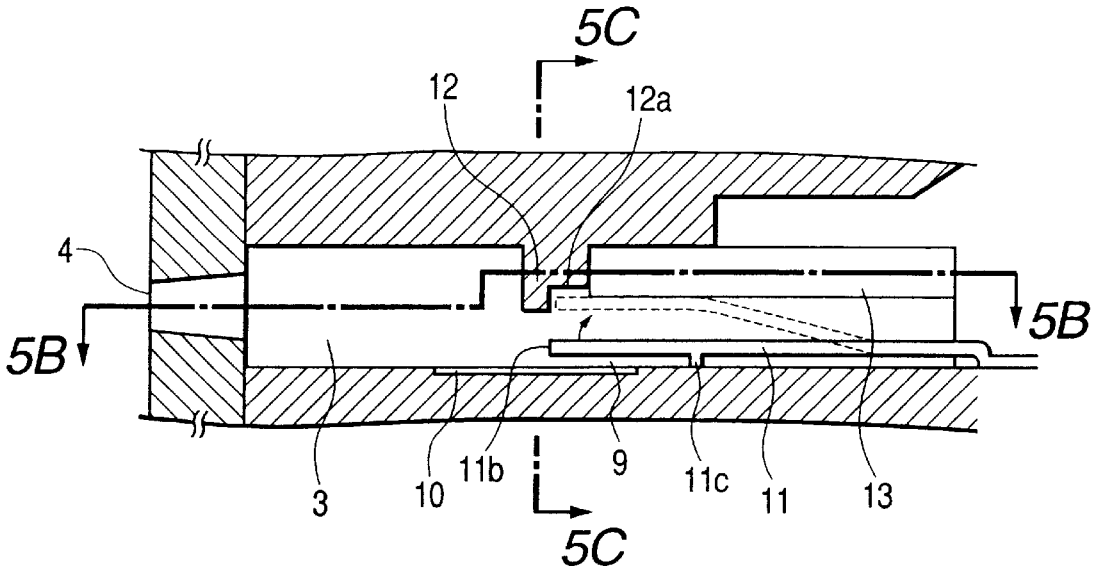
FIGS. 5A, 5B and 5C are sectional views showing a liquid discharge head according to a fourth embodiment of the present invention.
Figure 5B:
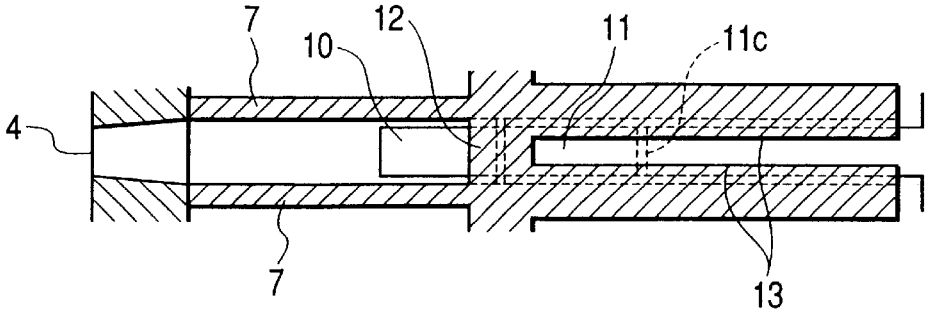
Figure 5C:
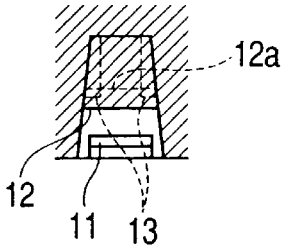

FIGS. 5A to 5C are sectional views showing a liquid discharge head according to a fourth embodiment of the present invention. In particular, FIG. 5A is a sectional views obtained by cutting in a direction along a flow path, FIG. 5B is a sectional views taken on line 5B—5B of FIG. 5A, and FIG. 5C is a sectional views taken on line 5C—5C of FIG. 5A. In FIGS. 5A to 5C, components identical to those in FIGS. 1A1 to 1F1 are designated by the identical reference numerals, and description of the identical components will be omitted.

The embodiment shown in FIGS. 5A to 5C is, in addition to the configuration of the first embodiment, constructed such that the upstream-side portion of the liquid flow regulating portion 12 is provided with a displacement regulating unit 12*a* for regulating the displacement of the movable member 11, the free end 11*b* of which has passed the vicinity of the surface (rear surface) of the liquid flow regulating portion 12 on the upstream side, and that the side wall 7 of the flow path 3 upstream of the displacement regulating unit 12*a* is provided with a side stopper 13, against which the upper surface of side edge of the movable member 11 abuts, so as to intercept a clearance between the movable member 11 and the flow path wall 7.

Such configuration has effects obtained by combining the second embodiment with the third embodiment. More specifically, leakage of the liquid and the bubble from the clearance portion between the movable member 11 caused by the upward displacement thereof and the flow path wall is prevented, and, after the liquid flow toward the upstream side is intercepted by the liquid flow regulating portion 12 and the movable member 11, the displacement of the movable member is quickly regulated. Therefore, it is possible to cause the growth of the bubble to contribute to formation of discharged liquid droplets more efficiently, and to improve the refilling property.

(Fifth Embodiment)

Figure 6A:
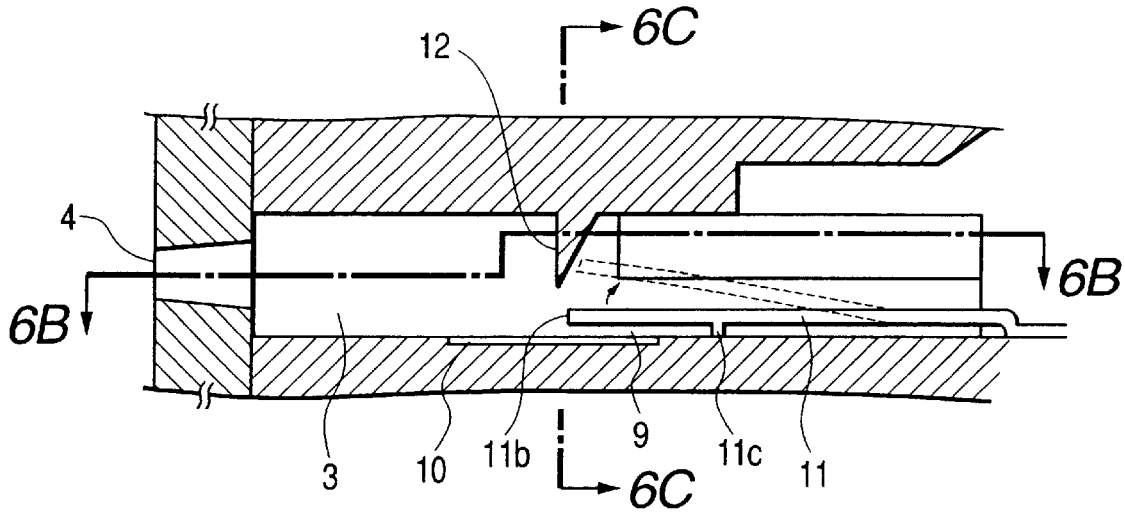
FIGS. 6A, 6B and 6C are sectional views showing a liquid discharge head according to a fifth embodiment of the present invention.
Figure 6B:
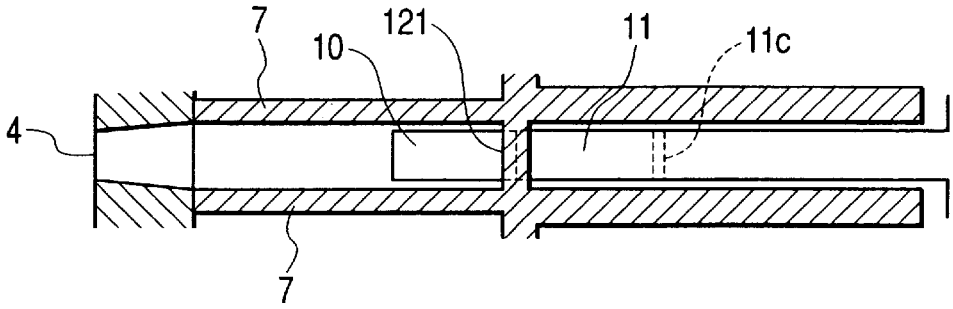
Figure 6C:
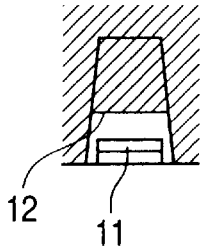

FIGS. 6A to 6C are sectional views showing a liquid discharge head according to a fifth embodiment of the present invention. In particular, FIG. 6A is a sectional views obtained by cutting in a direction along a flow path, FIG. 6B is a sectional views taken on line 6B—6B of FIG. 6A, and FIG. 6C is a sectional views taken on line 6Y—6Y of FIG. 6A. In FIGS. 6A to 6C, components identical to those in FIGS. 1A1 to 1F1 are designated by the identical reference numerals, and description of the identical components will be omitted.

In this embodiment, a liquid flow regulating portion 121 is constructed by forming the upstream-side portion of the liquid flow regulating portion of the first embodiment into a tapered configuration which tapers downwards from the flow path ceiling as shown in FIGS. 6A to 6C, and along the locus of the free end 11*b* of the movable member 11 during upward displacement.

With such configuration, since the width of the liquid flow regulating portion in the front-to-back direction can be made smaller than in the first embodiment, the volume of flow path on the discharge port side with the liquid flow regulating portion and the movable member as the border can be secured great, which is useful to discharge large liquid droplets (large dots). This is because the maximum discharge-able liquid droplet amount is proportionate to the flow path volume from the heater to the discharge port. Further, since the upstream-side portion of the liquid flow regulating portion 121 is formed into a tapered configuration, the flow path resistance from the upstream side during refilling can be reduced.

(Sixth Embodiment)

Figure 7A:
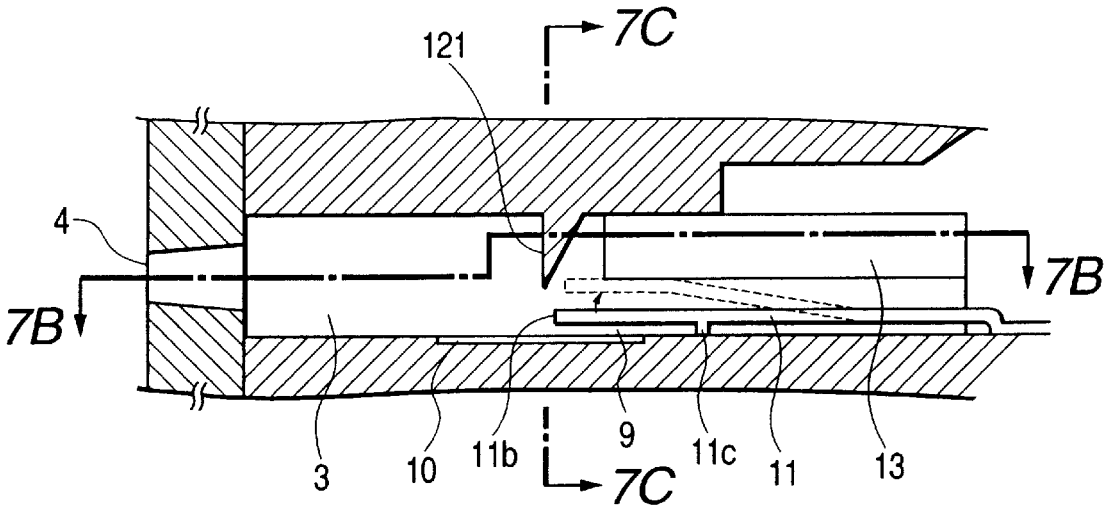
FIGS. 7A, 7B and 7C are sectional views showing a liquid discharge head according to a sixth embodiment of the present invention.
Figure 7B:
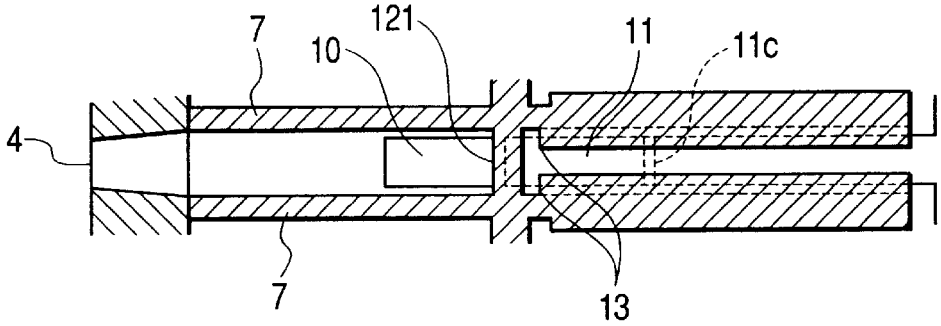
Figure 7C:
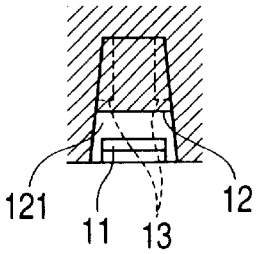

FIGS. 7A to 7C are sectional views showing a liquid discharge head according to a sixth embodiment of the present invention. In particular, FIG. 7A is a sectional views obtained by cutting in a direction along a flow path, FIG. 7B is a sectional views taken on line 7B—7B of FIG. 7A, and FIG. 7C is a sectional views taken on line 7C—7C of FIG. 7A. In FIGS. 7A to 7C, components identical to those in FIGS. 1A1 to 1F1 are designated by the identical reference numerals, and description of the identical components will be omitted.

In this embodiment, a liquid flow regulating portion 121 is constructed by forming the upstream-side portion of the liquid flow regulating portion of the first embodiment into a tapered configuration which tapers downwards from the flow path ceiling as shown in FIGS. 7A to 7C, and along the locus of the free end 11*b* of the movable member 11 during upward displacement, and the side wall 7 of the flow path 3 upstream of the liquid flow regulating portion 121 is provided with a side stopper 13, against which the upper surface of side edge of the movable member 11 abuts, so as to intercept a clearance between the movable member 11 and the flow path wall 7.

With such a configuration, since the width of the liquid flow regulating portion in the front-to-back direction can be made smaller than in the first embodiment, the volume of flow path on the discharge port side with the liquid flow regulating portion and the movable member as the border can be secured great, which is useful to discharge large liquid droplets. Further, since the upstream-side portion of the liquid flow regulating portion 121 is formed into a tapered configuration, the flow path resistance from the upstream side during refilling can be reduced.

In addition, since leakage of the liquid and the bubble from the clearance portion between the movable member 11 caused by the upward displacement thereof and the flow path wall is prevented, it is possible to cause the growth of the bubble to contribute to formation of discharged liquid droplets more efficiently, and to improve the refilling property.

(Seventh Embodiment)

Figure 8A:
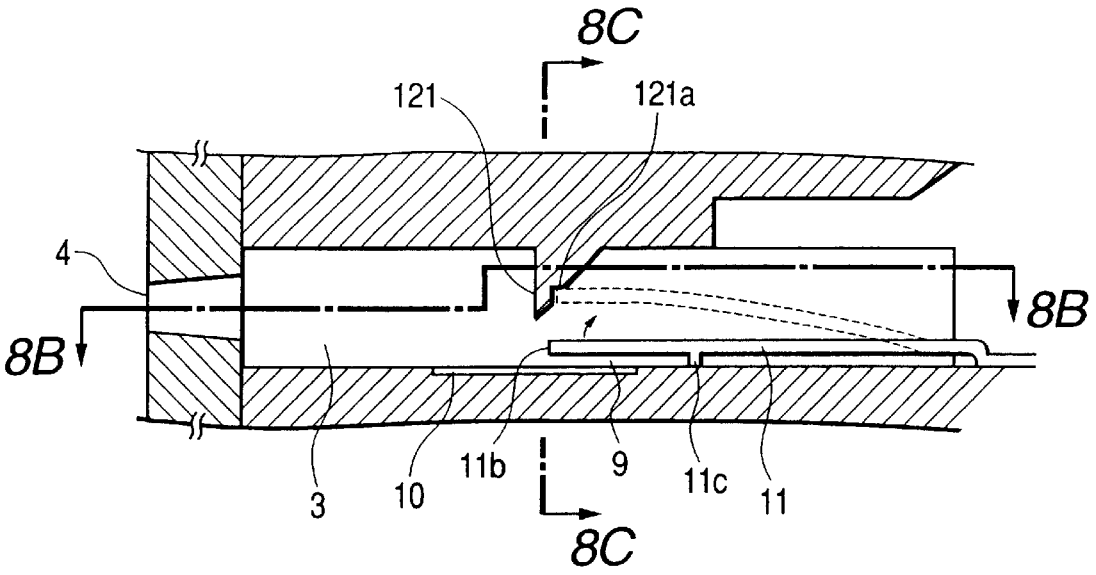
FIGS. 8A, 8B and 8C are sectional views showing a liquid discharge head according to a seventh embodiment of the present invention.
Figure 8B:
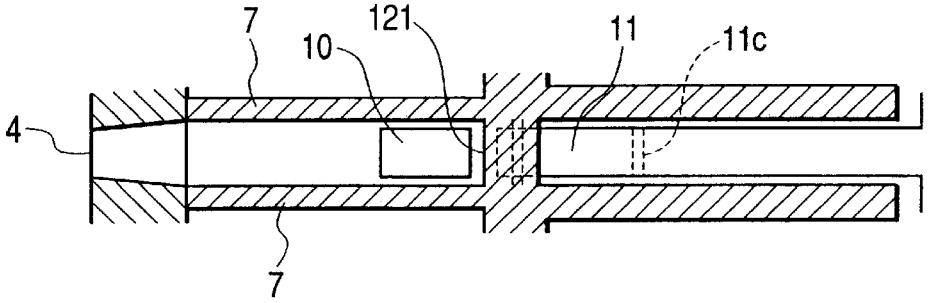
Figure 8C:
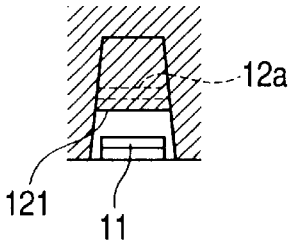

FIGS. 8A to 8C are sectional views showing a liquid discharge head according to a seventh embodiment of the present invention. In particular, FIG. 8A is a sectional views obtained by cutting in a direction along a flow path, FIG. 8B is a sectional views taken on line 8B—8B of FIG. 8A, and FIG. 8C is a sectional views taken on line 8C—8C of FIG. 8A. In FIGS. 8A to 8C, components identical to those in FIGS. 1A1 to 1F1 are designated by the identical reference numerals, and description of the identical components will be omitted.

In this embodiment, a liquid flow regulating portion 121 is constructed by forming the upstream-side portion of the liquid flow regulating portion of the first embodiment into a tapered configuration which tapers downwards from the flow path ceiling as shown in FIGS. 8A to 8C, and along the locus of the free end 11*b* of the movable member 11 during upward displacement, and the upstream-side portion of the liquid flow regulating portion 121 is provided with a displacement regulating unit 121*a* for regulating the displacement of the movable member 11 after the free end 11*b* of the movable member 11 passes through the vicinity of the surface of the liquid flow regulating portion 12 on the upstream side.

With such configuration, since the width of the liquid flow regulating portion in the front-to-back direction can be made smaller than in the first embodiment, the volume of flow path on the discharge port side with the liquid flow regulating portion and the movable member as the border can be secured great, which is useful to discharge large liquid droplets. Further, since the upstream-side portion of the liquid flow regulating portion 121 is formed into a tapered configuration, the flow path resistance from the upstream side during refilling can be reduced.

In addition, after the liquid flow toward the upstream side is intercepted by the liquid flow regulating portion 12 and the movable member 11, the liquid flow toward the upstream side (to the rear) caused by the upward displacement of the movable member 11 is quickly regulated. Therefore, it is possible to cause the growth of the bubble to contribute to formation of discharged liquid droplets more efficiently, and to improve the refilling property.

(Eighth Embodiment)

Figure 9A:
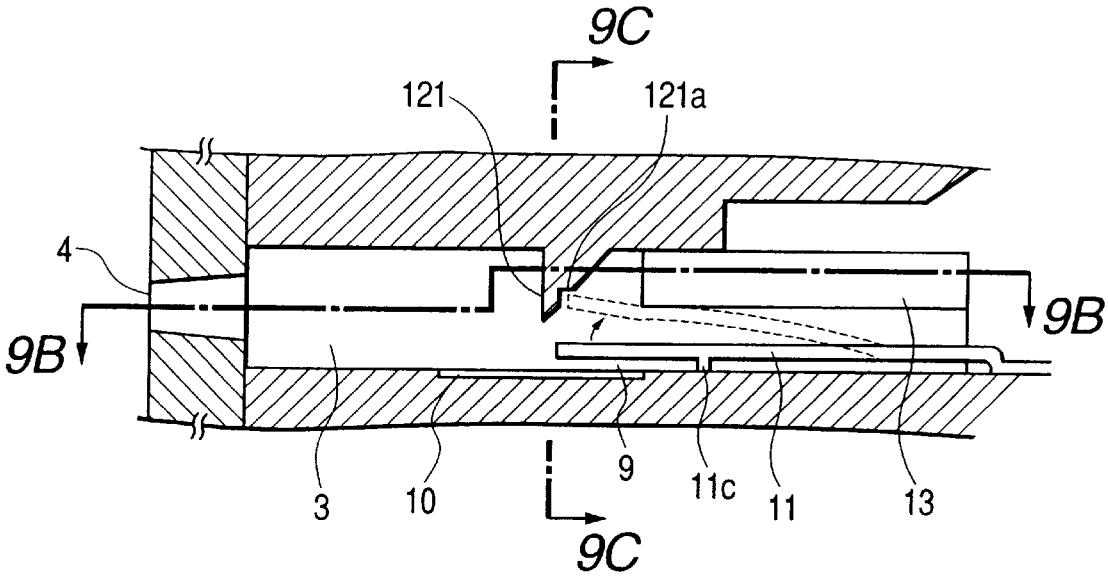
FIGS. 9A, 9B and 9C are sectional views showing a liquid discharge head according to an eighth embodiment of the present invention.
Figure 9B:
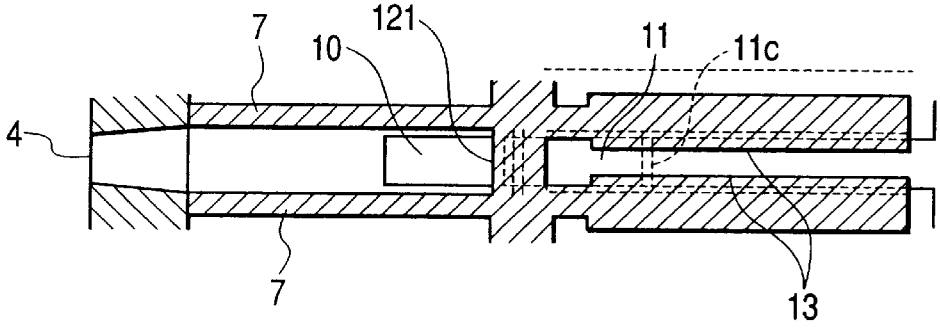
Figure 9C:
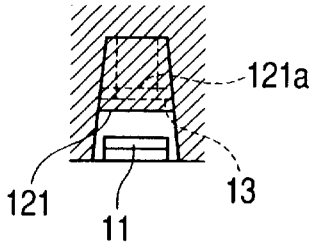
Figure 10A:
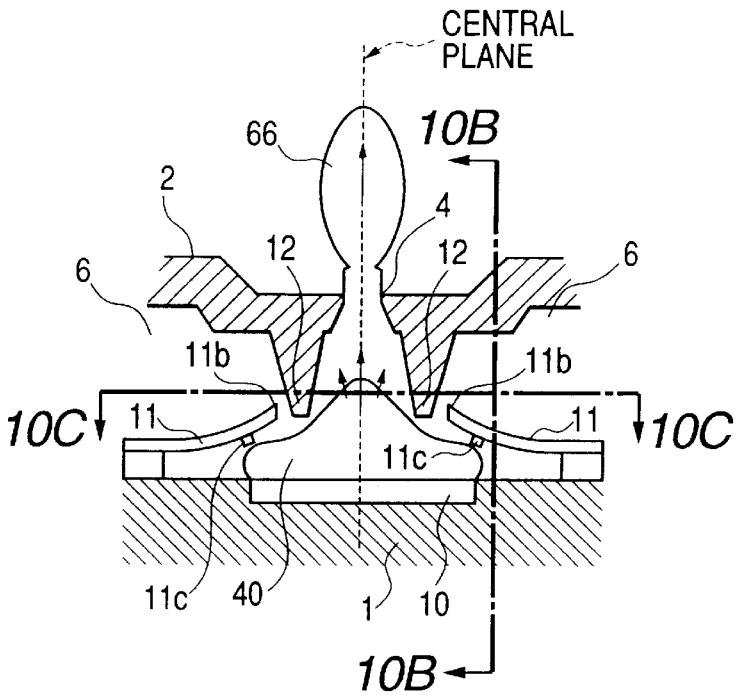
FIGS. 10A, 10B and 10C are explanatory views for illustrating an example of a side shooter type head to which a liquid discharging method according to the present invention is applied.
Figure 10B:
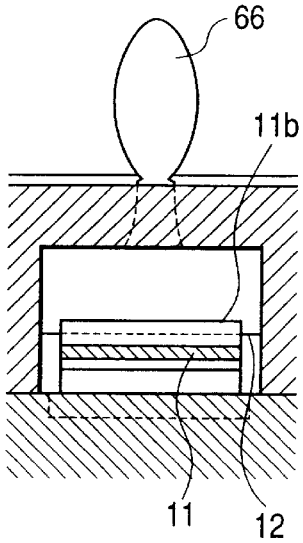
Figure 10C:
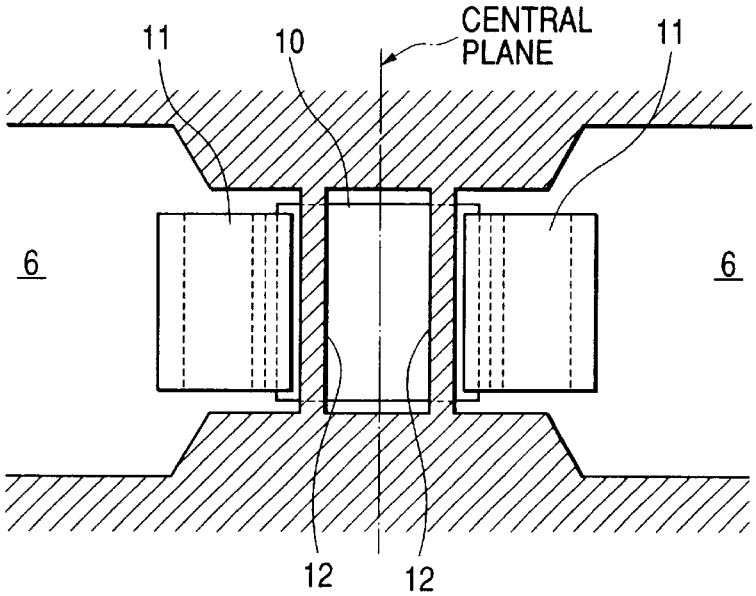

FIGS. 9A to 9C are sectional views showing a liquid discharge head according to an eighth embodiment of the present invention. In particular, FIG. 9A is a sectional views obtained by cutting in a direction along a flow path, FIG. 9B is a sectional views taken on line 9B—9B of FIG. 9A, and FIG. 9C is a sectional views taken on line 9C—9C of FIG. 9A. In FIGS. 9A to 9C, components identical to those in FIGS. 1A1 to 1F1 are designated by the identical reference numerals, and description of the identical components will be omitted.

In this embodiment, a liquid flow regulating portion 121 is constructed by forming the upstream-side portion of the liquid flow regulating portion of the first embodiment into a tapered configuration which tapers downwards from the flow path ceiling as shown in FIGS. 9A to 9C, and along the locus of the free end 11*b* of the movable member 11 during upward displacement, and the upstream-side portion of the liquid flow regulating portion 121 is provided with a displacement regulating unit 121*a* for regulating the displacement of the movable member 11 after the free end 11*b* of the movable member 11 passes through the vicinity of the surface of the liquid flow regulating portion 12 on the upstream side, and then the side wall 7 of the flow path 3 upstream of the displacement regulating unit 121*a* is provided with a side stopper 13, against which the upper surface of side edge of the movable member 11 abuts, so as to intercept a clearance between the movable member 11 and the flow path wall 7.

Such configuration has effects obtained by combining the sixth embodiment with the seventh embodiment. More specifically, since the width of the liquid flow regulating portion in the front-to-back direction can be made smaller than in the first embodiment, the volume of flow path on the discharge port side with the liquid flow regulating portion and the movable member as the border can be secured great, which is useful to discharge large liquid droplets. Further, since the upstream-side portion of the liquid flow regulating portion 121 is formed into a tapered configuration, the flow path resistance from the upstream side during refilling can be reduced.

In addition, leakage of the liquid and the bubble from the clearance portion between the movable member 11 caused by the upward displacement thereof and the flow path wall is prevented, and, after the liquid flow toward the upstream side is intercepted by the liquid flow regulating portion 12 and the movable member 11, the displacement of the movable member 11 is quickly regulated. Therefore, it is possible to cause the growth of the bubble to contribute to formation of discharged liquid droplets more efficiently, and to improve the refilling property.

(Other Embodiments)

Hereinafter, the description will be made of various embodiments suitable for a head using the above described liquid discharging method.

<Side Shooter Type>

A description will be made of a side shooter type head, in which the heater and the discharge port are opposed on a parallel plane, and to which the principle of liquid discharge explained using FIGS. 1A1 to 1F1 and FIGS. 2A to 2C is applied. FIGS. 10A to 10C to FIGS. 12A to 12C are explanatory views for illustrating examples of the side shooter type head.

In FIG. 10, the heater 10 on the element substrate 1 and the discharge port 4 formed on the ceiling plate 2 are disposed so as to oppose to each other. The discharge port 4 communicates to the liquid flow path 3 provided on the heater 10. In the neighboring area of a surface in which the heater 10 is in contact with the liquid, there exists the bubble generating area. Two movable members 11 are supported on the element substrate 1, the respective movable members are formed to become plane-symmetrical with respect to a plane which passes the center of the heater, and free ends 11*b* of the movable members 11 are each located facing each other on the heater 10. These movable members 11 have an identical projected area onto the heater 10, and free ends of the movable members 11 are each located at a predetermined interval. Assuming that these movable members are divided by a plane which passes the center of the heater as a partition wall, the movable members are provided such that the free end of each movable member is located near the center of each heater divided respectively.

The ceiling plate 2 is provided with a liquid flow regulating portion 12 for intercepting the liquid flow toward the upstream side in the displacement process of the movable member 11 caused by the growth of the bubble, and the growth toward the upstream side of the bubble which goes around the free end 11*b* of the movable member 11 caused by the liquid flow. In the flow from the common liquid chamber 6 to the discharge port 4, there is provided a low flow path resistance area having lower flow path resistance relative to the liquid flow path 3 upstream of the liquid flow regulating portion 12. As the configuration of the flow path in this area, the area has a larger cross-sectional area of flow path than the liquid flow path 3 to thereby reduce the resistance which undergoes from the flow path in the movement of the liquid. In addition, since the upstream side of the liquid flow regulating portion 12 is formed into a tapered configuration which tapers toward the tip end, the flow path resistance from the upstream side during refilling can be reduced even by this configuration.

Figure 11A:
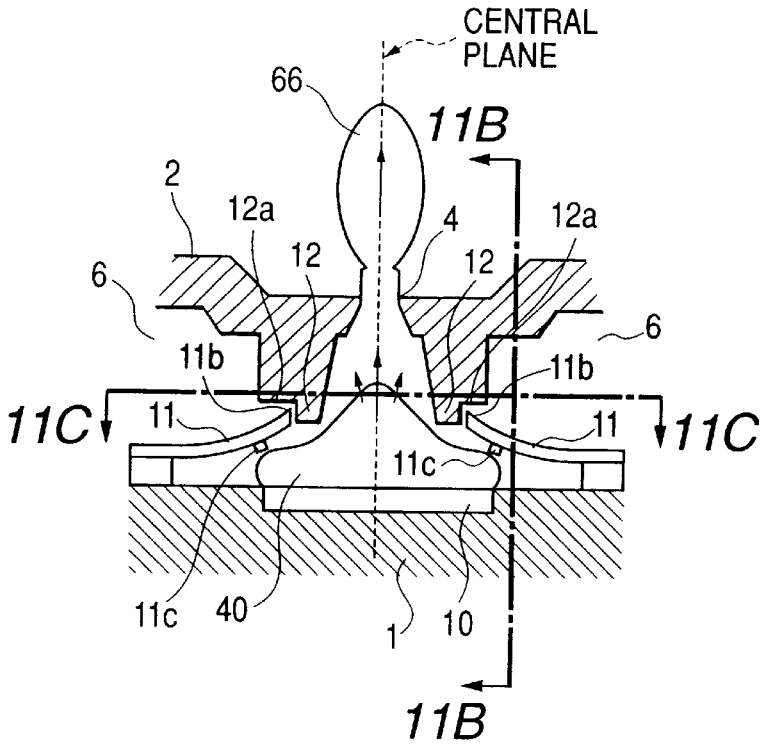
FIGS. 11A, 11B and 11C are explanatory views for illustrating an example of the side shooter type head to which the liquid discharging method according to the present invention is applied.
Figure 11B:
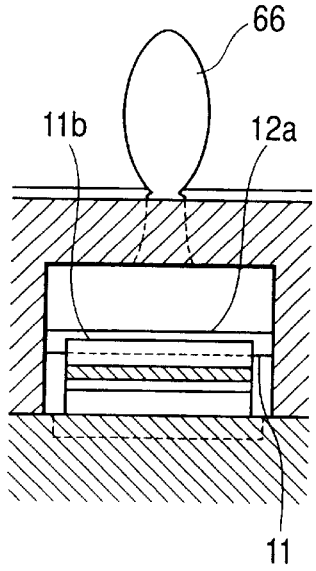
Figure 11C:
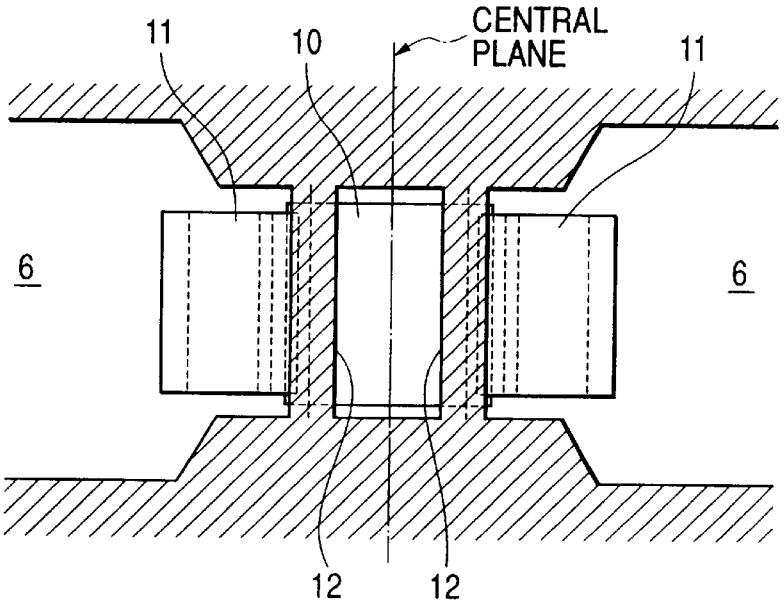

Further, as shown in FIGS. 11A to 11C, the upstream-side portion of the liquid flow regulating portion 12 may be provided with a displacement regulating unit 121*a* for regulating the displacement of the movable member 11 after the free end 11*b* of the movable member 11 passes through the vicinity of the surface of the liquid flow regulating portion 12 on the upstream side. When this configuration is adopted, after the liquid flow toward the upstream side is intercepted by the liquid flow regulating portion 12 and the movable member 11, the displacement of the movable member 11 can be regulated immediately. Therefore, the liquid hardly moves toward the upstream side by the displacement of the movable member 11, and the refilling property can be improved.

Figure 12A:
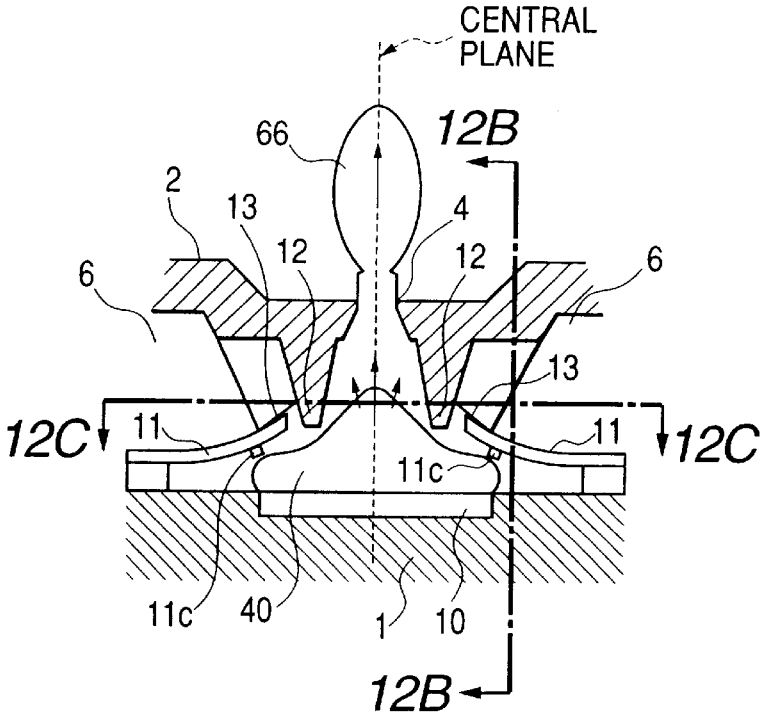
FIGS. 12A, 12B and 12C are explanatory views for illustrating an example of the side shooter type head to which the liquid discharging method according to the present invention is applied.
Figure 12B:
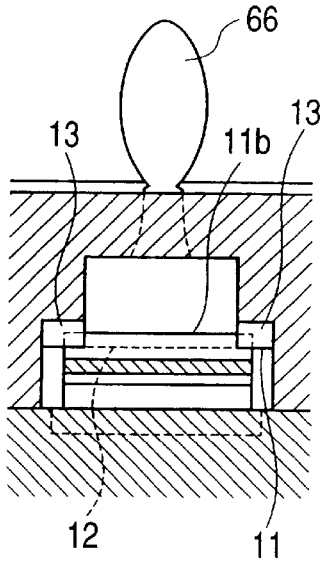
Figure 12C:
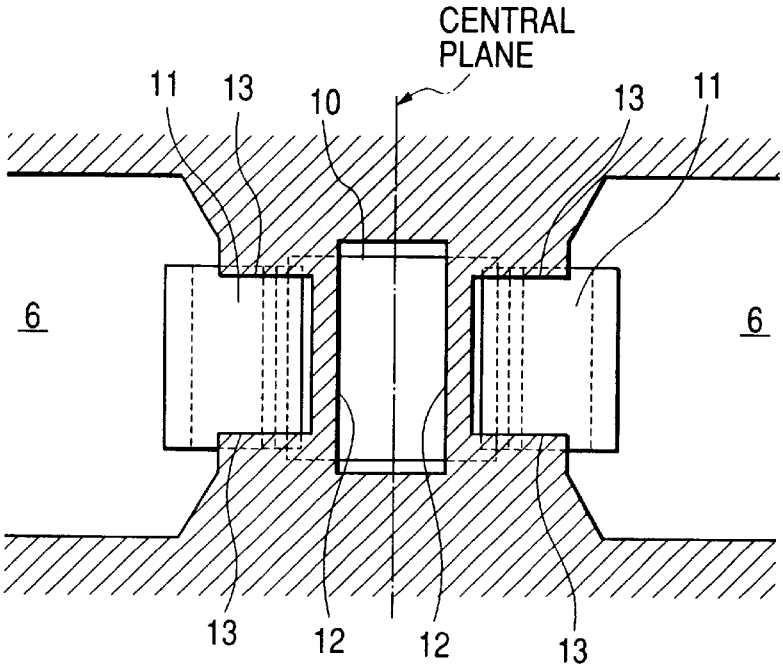

Further, as shown in FIGS. 12A to 12C, the side wall 7 of the flow path 3 upstream of the liquid flow regulating portion 12 may be provided with a side stopper 13, against which the upper surface of side edge of the movable member 11 abuts, so as to intercept a clearance between the movable member 11 and the flow path wall 7. When this configuration is adopted, since leakage of the liquid and the bubble, caused by the upward displacement of the movable member 11, from the clearance portion between the movable member 11 and the flow path wall can be prevented, it is possible to cause the growth of the bubble to contribute to formation of discharged liquid droplets more efficiently, and to improve the refilling property. Also, since the clearance portion can be set loosely, the assembling property of the movable member to be arranged in the flow path is improved.

Figure 13A:
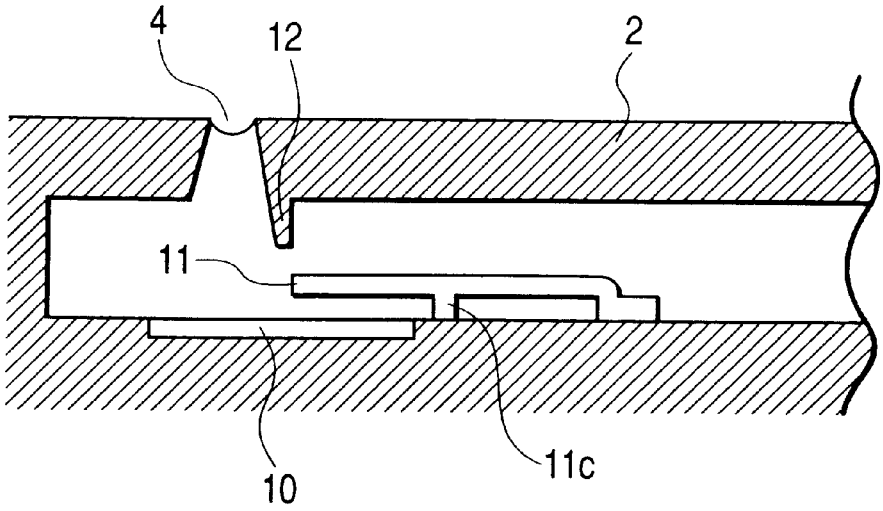
FIGS. 13A and 13B are explanatory views for illustrating an example of the side shooter type head to which the liquid discharging method according to the present invention is applied.
Figure 13B:
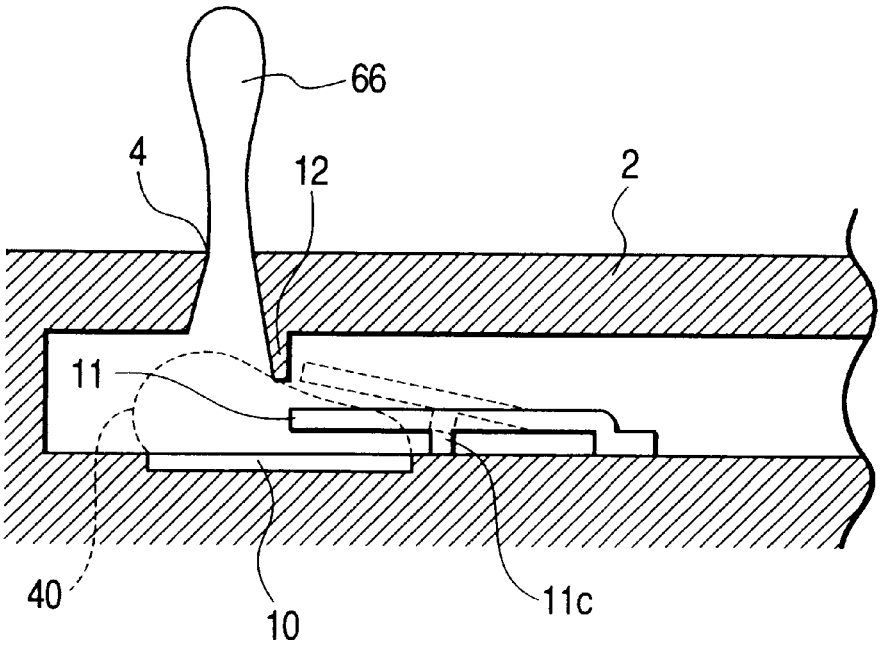
Figure 14A:
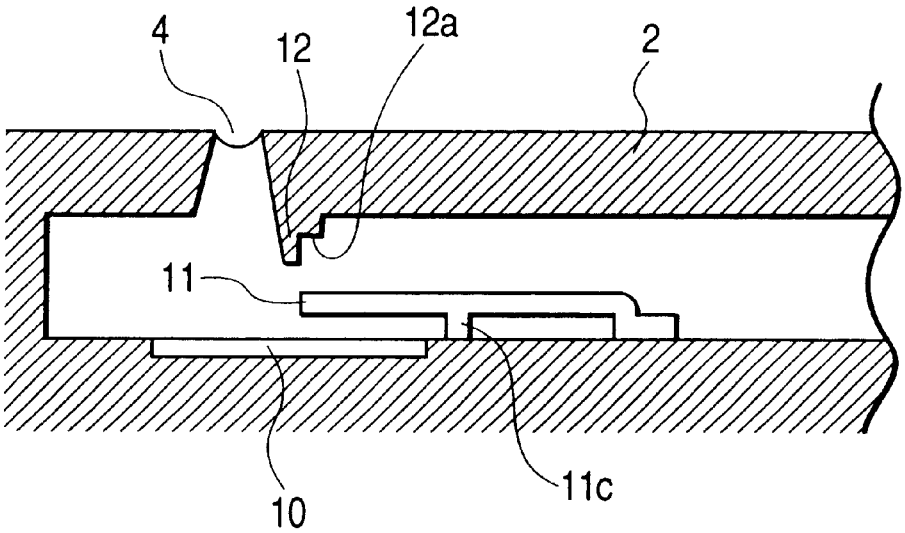
FIGS. 14A and 14B are explanatory views for illustrating an example of the side shooter type head to which the liquid discharging method according to the present invention is applied.
Figure 14B:
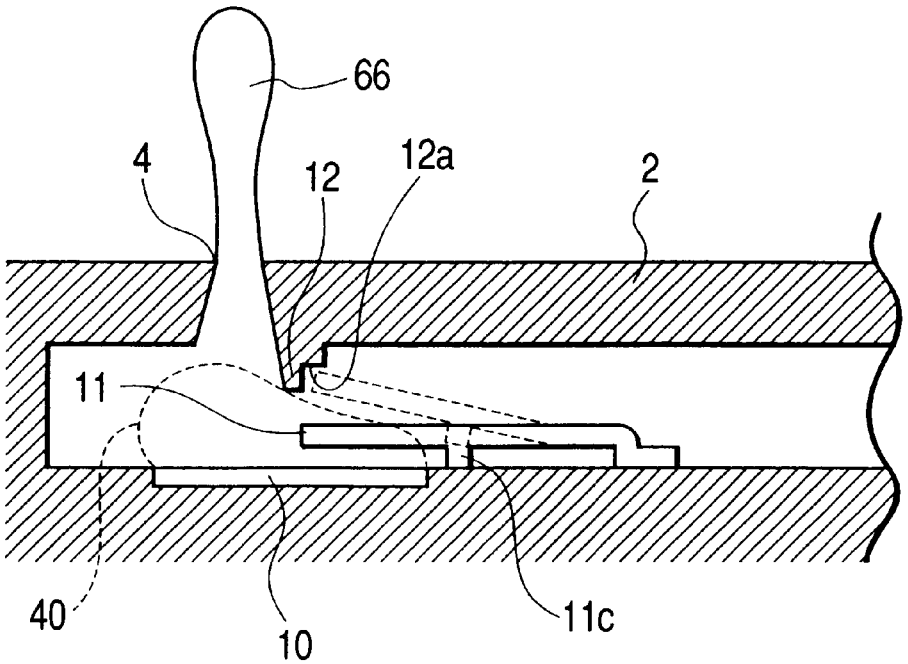
Figure 15A:
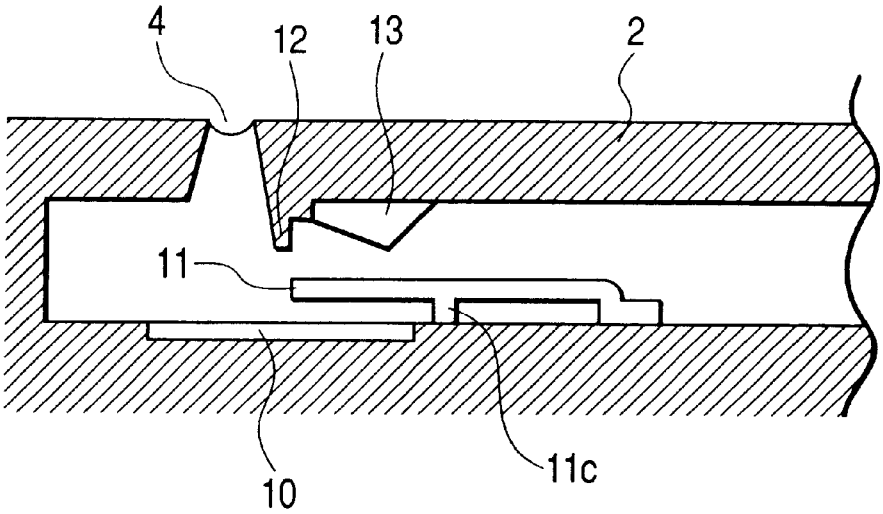
FIGS. 15A and 15B are explanatory views for illustrating an example of the side shooter type head to which the liquid discharging method according to the present invention is applied.
Figure 15B:
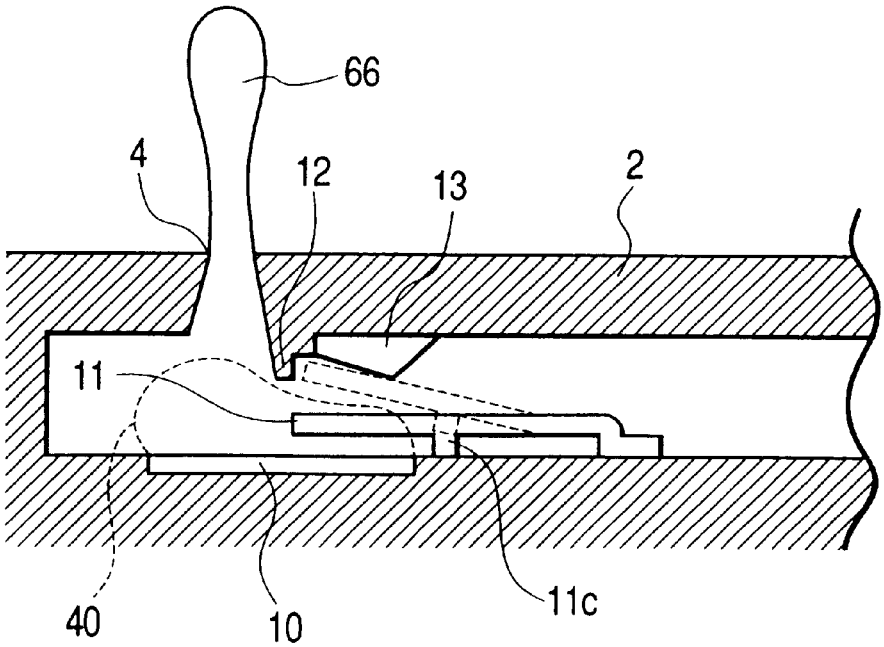

FIGS. 13A and 13B to FIGS. 15A and 15B show configuration in which one movable member is provided for one heater, FIGS. 13A and 13B show configuration in which the liquid flow regulating portion 12 is provided, FIGS. 14A and 14B show configuration in which the displacement regulating unit 12*a* is provided in addition to the liquid flow regulating portion 12, and FIGS. 15A and 15B show configuration in which the side stopper 13 is provided in addition to the liquid flow regulating portion 12. In this respect, in the embodiments shown in FIGS. 12A and 12B, and FIGS. 15A and 15B, in order to enhance an effect of inhibiting an inertia force of the liquid toward the upstream side, a contact surface of the side stopper 13 provided in the flow path with the movable member 11 is provided with an inclined portion of a direction that retracts from the substrate toward the downstream side of the liquid flow path. This inclined portion can improve the contact state with the stopper 13 when the movable member 11 rises. This further reduces ink flow toward the upstream side at the time of expanding (bubble generation) to further improve the meniscus vibration inhibiting effect.

Next, the description will be made of characteristic operations and effects based on configuration of this embodiment.

FIGS. 10A to 10C and FIGS. 13A and 13B show a state in which a portion of liquid, which fills the bubble generating area, is heated by the heater 10 and a bubble 40 caused by film boiling grows to the maximum. At this time, pressure based on the occurrence of the bubble 40 moves the liquid within the liquid flow path toward the discharge port 4, the growth of the bubble 40 shifts each movable member 11, and a discharge droplet 66 is going to jump out from the discharge port 4. In this case, the movement of the liquid toward the upstream side is turned into a large flow by the low flow path resistance area. When the movable member 11 shifts until the free end 11*b* thereof is arranged in proximity to the surface of the liquid flow regulating portion 12 on the upstream side, the movement of the liquid toward the upstream side is largely restricted there. At the same time, the growth of the bubble 40 toward the upstream side is also limited by the movable member 11. At this time, when the configuration shown in FIGS. 11A to 11C or FIGS. 14A and 14B is adopted, after the liquid flow toward the upstream side is intercepted by the liquid flow regulating portion 12 and the movable member 11, the displacement of the movable member 11 can be regulated immediately. Therefore, the liquid hardly moves toward the upstream side by the displacement of the movable member 11, and the refilling property can be improved. Further, when the configuration shown in FIGS. 12A to 12C or FIGS. 15A and 15B is adopted, since, even if the clearance between the movable member 11 and the flow path side wall 7 may be large, the clearance is intercepted by the side stopper 13, the growth of the bubble can be caused to contribute to formation of discharged droplets more efficiently.

When shrinkage of the bubble 40 is started after the free end 11*b* of the movable member 11 is arranged in proximity to the surface of the liquid flow regulating portion 12 on the upstream side to intercept the liquid flow toward the upstream side, the shrinkage of the bubble 40 mostly moves the liquid from the discharge port 4 toward the upstream side at this point of time. Therefore, the meniscus is largely drawn into the liquid flow path 3 from the discharge port 4 at this point of time to quickly cut off the liquid column connected to the discharged liquid droplet 66 with a strong force. As a result, the liquid droplet remained in the outside of the discharge port 4, that is, satellite becomes fewer.

When the bubble generation process is substantially completed, the repulsion (restoring force) of the movable member 11 overcomes the moving force of the liquid toward the upstream side in the low flow path resistance area to start the downward displacement of the movable member 11 and the flow toward the downstream side in the low flow path resistance area caused by the downward displacement. At the same time, the flow toward the downstream side in the low flow path resistance area is quickly turned into a large flow because of low flow path resistance to flow into the liquid flow path 3 through the liquid flow regulating portion 12.

In this embodiment, the refilling property is enhanced at higher speed by supplying the discharging liquid from the low flow path resistance area in this manner. Also, since the common liquid chamber adjacent to the low flow path resistance area has lower flow path resistance, further high-speed refilling is realized.

Further, in the bubble disappearing for the bubble 40, the clearance between the side stopper 13 and the movable member 11 promotes the liquid flow from the low flow path resistance area to the bubble generating area 11, and combines with rapid supply of the liquid over the surface of the movable member 11 which is caused when the movable member 11 is separated from the liquid flow regulating portion 12 to complete the bubble disappearance quickly.

<Movable Member>

In the previous embodiment, as material constituting the movable member, it will suffice so long as it has resistance to solvent attack against the discharging liquid, and elasticity necessary for satisfactorily operating as a movable member.

As material for the movable member, metal such as silver, nickel, gold, iron, titanium, aluminum, platinum, tantalum, stainless steel and phosphor bronze, which have high durability, and their alloy, or resin having nitrile group such as acrylonitrile, butadiene and styrene, resin having amide group such as polyamide, resin having carboxyl group such as polycarbonate, resin having aldehyde group such as polyacetal, resin having sulfone group such as polysulfone, and in addition, resin such as liquid crystal polymer and its chemical compound, metal having high ink resistance such as gold, tungsten, tantalum, nickel, stainless steel, and titanium, and their alloy, concerning the ink resistance, those obtained by coating these on the surface, or resin having amide group such as polyamide, resin having aldehyde group such as polyacetal, resin having ketone group such as polyether, ether and ketone, resin having imide group such as polyimide, resin having hydroxyl group such as phynolic type resin, resin having ethyl group such as polyethylene, resin having alkyl group such as polypropylene, resin having epoxy group such as epoxy resin, resin having amino group such as melamine resin, resin having methylol group such as xylene resin, and their chemical compounds, and further ceramic such as silicon dioxide and silicon nitride and their chemical compounds are desirable. As the movable member according to the present invention, thickness on the order of $\mu$m is used.

Next, the description will be made of arrangement relationship between the heater and the movable member. Optimum arrangement of the heater and the movable member enables the liquid flow during bubble generating using the heater to be properly controlled for effective utilization.

Figure 16:
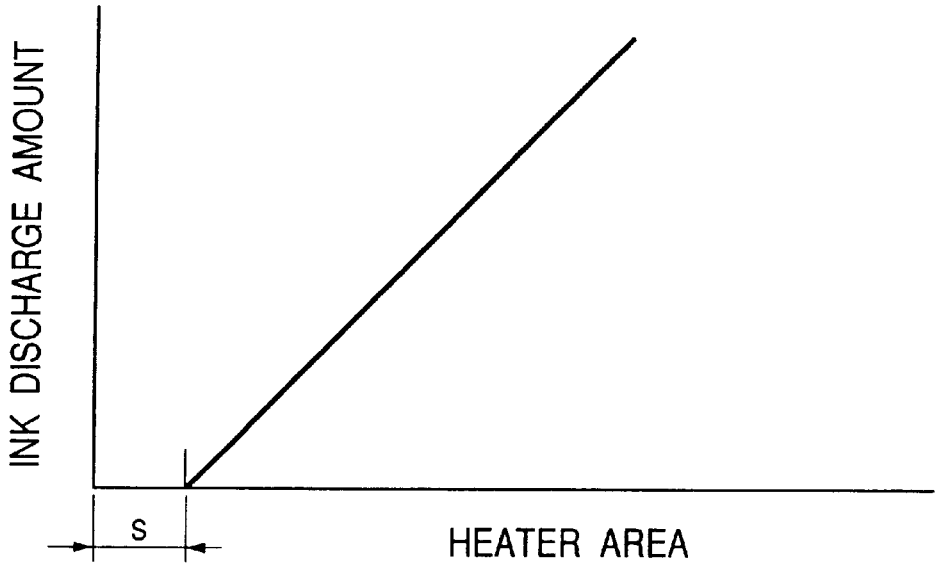
FIG. 16 is a graph showing correlation between heater area and ink discharge amount.

In the prior art of an ink jet recording method, a so-called bubble jet recording method for forming an image by applying energy such as heat to ink to cause a change in state accompanied by a sudden volume change (occurrence of the bubble) to the ink, and discharging the ink through the discharge port by an operating force based on this change in state to cause it to adhere onto the recording medium, the heater area is proportionate to the ink discharge amount as shown in FIG. 16, and it can be seen that there exists an effective non-bubble generating area S which does not contribute to ink discharge. From the appearance of scorched heater, it can be seen that this effective non-bubble generating area S exists around the heater. From these results, it is understood that width of about 4 $\mu$m around the heater has nothing to do with bubble generating.

Therefore, in order to effectively utilize bubble generating pressure, a portion immediately above an effective bubble generating area about 4 $\mu$m or more inside the circumference of the heater is an area which effectively operates on the movable member, in case of the present invention, the bubble generating area is divided into an upstream side and a downstream side with its substantially central area (actually, a range of ± about 10 $\mu$m from the center in the liquid flowing direction) as the border, concerning operations of a bubble on the liquid flow within the liquid path on the upstream side and on the downstream side, the operations are divided into two stages: one is to perform the operations independently and the other is to perform them synthetically, and it is very important to focus attention to these two stages, and to arrange the movable member in such a manner that only the upstream-side portion of the central area opposes to the movable member. In this embodiment, the effective bubble generating area has been set to be about 4 $\mu$m or more inside the circumference of the heater, but the present invention is not limited thereto depending upon the type of the heater and forming method.

In order to satisfactorily form the above described substantially closed space, the distance between the movable member and the heater which are in a standby state is preferably set to 10 $\mu$m or less.

<Element Substrate>

Hereinafter, the detailed description will be made of the configuration of the element substrate 1 provided with the heater 10 for applying heat to the liquid.

Figure 17A:
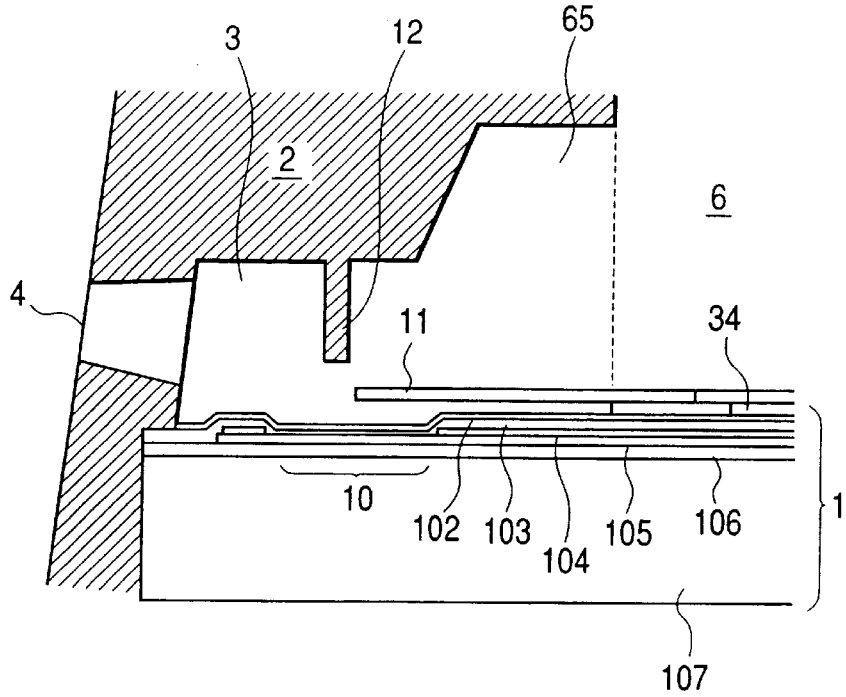
FIGS. 17A and 17B are longitudinal sectional views showing a liquid discharge head according to the present invention.
Figure 17B:
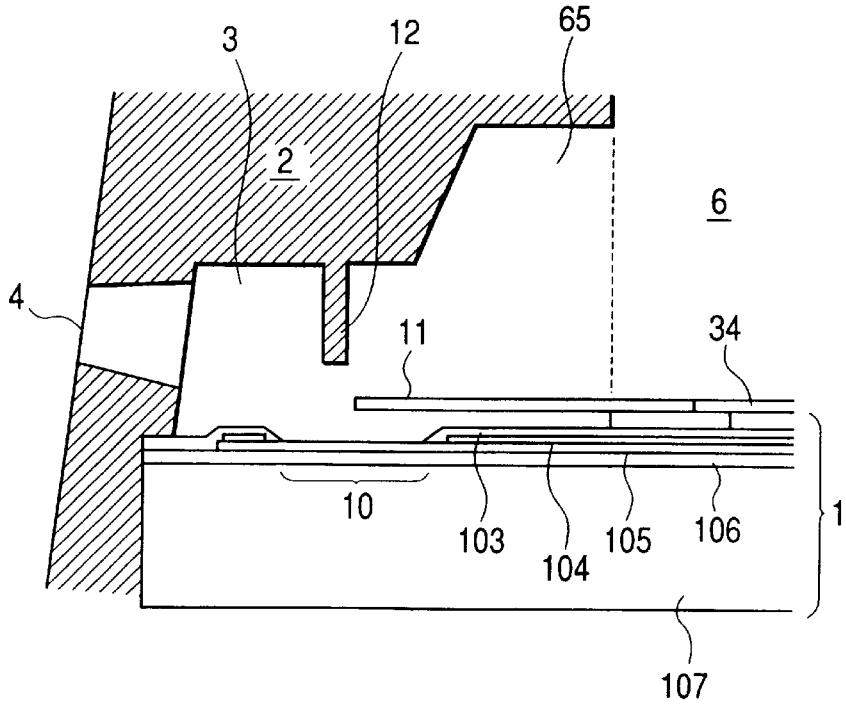

FIGS. 17A and 17B are partial side sectional views showing a liquid discharge head according to the present invention, and FIG. 17A shows the liquid discharge head with a protective film to be described later, and FIG. 17B shows the liquid discharge head without any protective film;

On the element substrate 1, there is arranged a ceiling plate 2 with groove provided with the groove constituting the above described flow path 3.

The element substrate 1 is constructed such that silicon oxide film or silicon nitride film 106 aimed at insulation and heat reserve is formed as the film on a substrate 107 made of silicon or the like, on top of which an electric resistive layer 105 (0.01 to 0.2 $\mu$m in thickness) such as hafnium bolide (HfB2), tantalum nitride (TaN) and tantalum aluminum (TaAl) constituting the heater 10, and wiring electrode 104 (0.2 to 1.0 $\mu$m in thickness) such as aluminum are patterned as shown in FIG. 17A. Voltage is applied to a resistive layer 105 from this wiring electrode 104, and electric current is caused to flow through the resistive layer 105 to generate heat. On the resistive layer 105 between wiring electrodes 104, protective film 103 made of silicon oxide, silicon nitride or the like is formed at thickness of 0.1 to 2.0 $\mu$m, on top of which a cavitation-resistant layer 102 (0.1 to 0.6 $\mu$m in thickness) made of tantalum or the like is further formed as the film to protect the resistive layer 105 from various liquid such as ink.

Particularly, pressure or impact waves, which is generated during occurrence of the bubble or bubble disappearance is very strong, and noticeably deteriorates the durability of the oxide film which is hard and fragile, and therefore, tantalum (Ta) or the like of metallic material is used as the cavitation-resistant layer 102.

By a combination of liquid, configuration of flow path and resistant material, configuration, in which the above described resistive layer 105 does not necessitate any protective film 103, may be used, and its example is shown in FIG. 17B. As the material for such resistive layer 105 necessitating no protective film 103, iridium-tantalum-aluminum alloy or the like is used.

In this manner, as the configuration of the heater 10 in each of the above described embodiments, only the above described resistive layer 105 (heat generating portion) between electrodes 104 will suffice, and the protective film 103 for protecting the resistive layer 105 may be included.

In each embodiment, there has been used the heater 10 having the heat generating portion constituted by the resistive layer 105 for generating heat in response to an electric signal, but the present invention is not limited thereto, but it will suffice so long as sufficient the bubble to discharge the discharging liquid can be caused to the bubble generating liquid. For example, such photothermo-transducers as to generate heat by receiving light such as laser or any heater having such a heat generating portion as to generate heat by receiving high frequency may be used.

In this respect, the above described element substrate 1 may be integrally incorporated, by a semiconductor manufacturing process, with a functional device such as transistor, diode, latch and shift register for selectively driving this heater 10 (electrothermal transducers) in addition to the heater 10 composed of the resistive layer 105 constituting the heat generating portion and the wiring electrode 104 for supplying an electric signal to the resistive layer 105.

Figure 18:
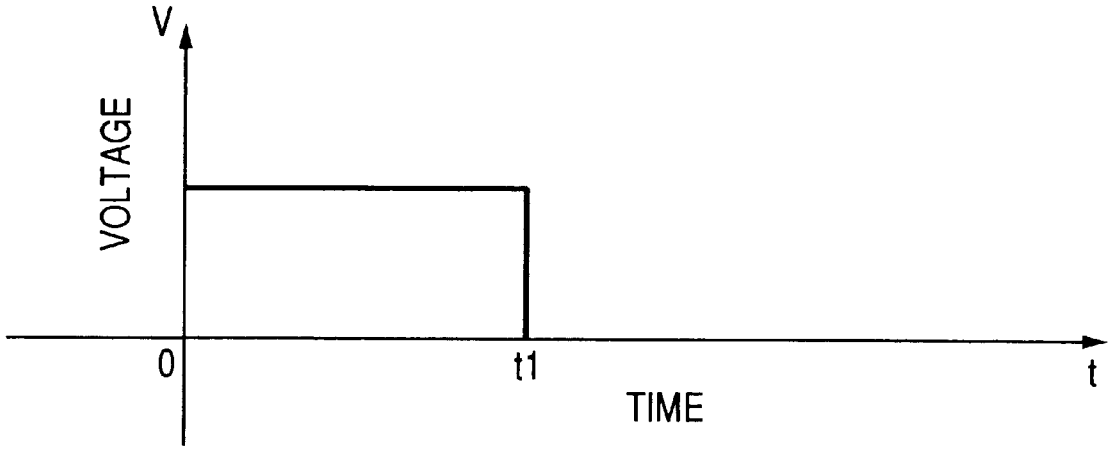
FIG. 18 is a view showing a waveform in which a heater used in the present invention is driven.

In order to discharge the liquid by driving the heat generating portion of the heater 10 provided in such element substrate 1 as described above, such a rectangular pulse as shown in FIG. 18 is applied to the resistive layer 105 through the wiring electrode 104 to thereby cause the resistive layer 105 between the wiring electrodes 104 to suddenly generate heat. In the head of each of the above described embodiments, the heater is driven by applying voltage of 24V, pulse width of 7 μsec., current of 150 mA and an electric signal at 6 kHz respectively, and ink in the form of liquid is discharged through the discharge port 4 by the operations described above. However, the conditions for the driving signal are not limited thereto, but it will suffice so long as it is a driving signal capable of appropriately expanding the expanding liquid.

<Recording Apparatus>

Figure 19:
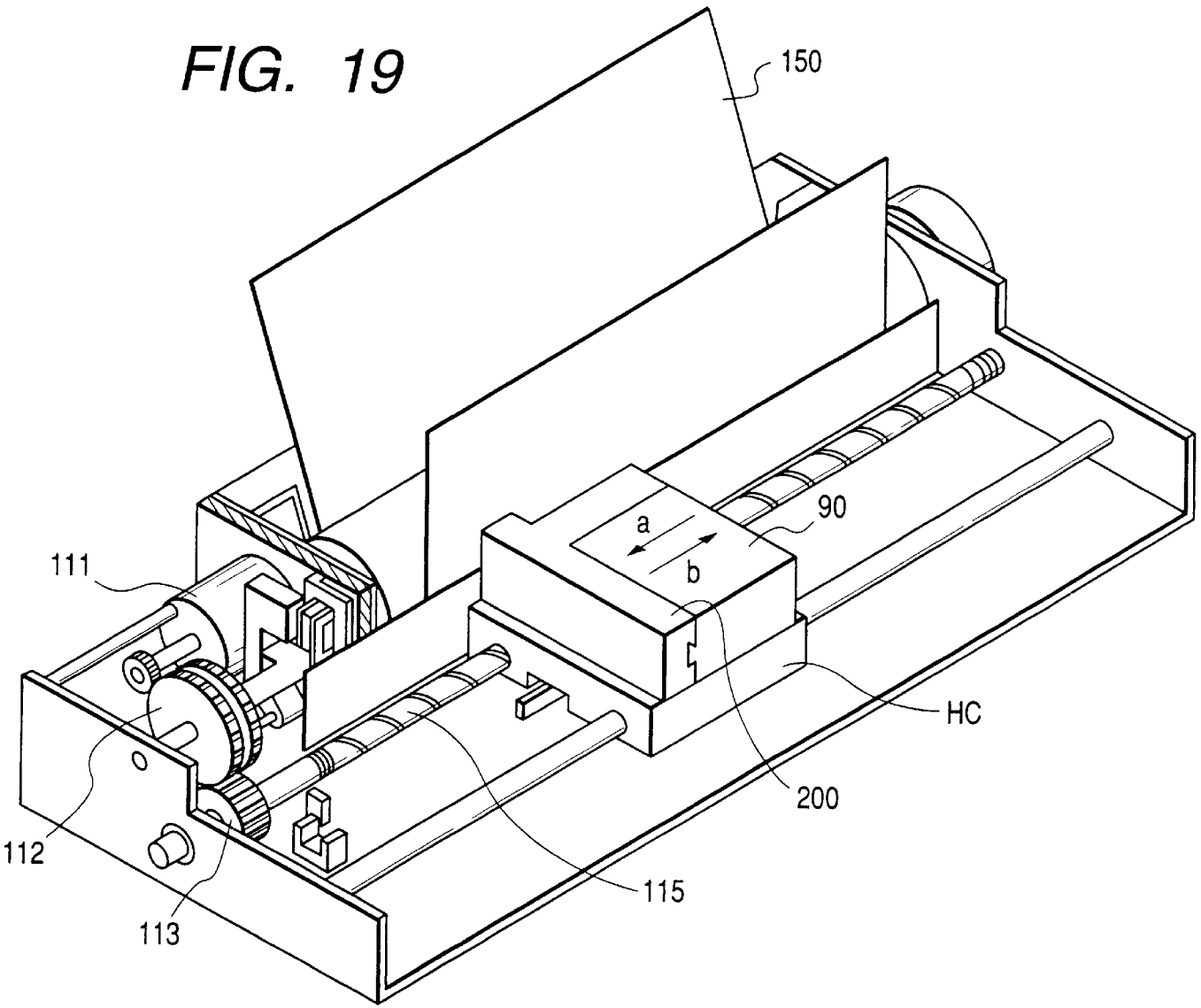
FIG. 19 is a view schematically showing configuration of a liquid discharge apparatus on which a liquid discharge head according to the present invention has been mounted.

FIG. 19 shows an ink jet recording apparatus incorporating the above described liquid discharging apparatus and using ink as the discharging liquid. A carriage HC is mounted with a head cartridge in which a liquid tank 90 for containing ink and a recording head 200, which is a liquid discharging apparatus, are detachable, and reciprocates in the widthwise direction of a recording medium 150 such as recording sheet to be conveyed by recording medium conveying means.

When a driving signal is supplied to the liquid discharge means on the carriage HC from driving signal supply means (not shown), ink (recording liquid) is discharged onto the recording medium from the recording head unit in response to this signal.

A recording apparatus according to this embodiment has a motor 111 as a driving source for driving the recording medium conveying means and the carriage, gears 112 and 113 for transmitting power from the driving source to the carriage, a carriage shaft 115 or the like. By means of the recording apparatus and the liquid discharging method to be performed using this recording apparatus, recording articles with good images could be obtained by discharging the liquid onto various recording media.

Figure 20:
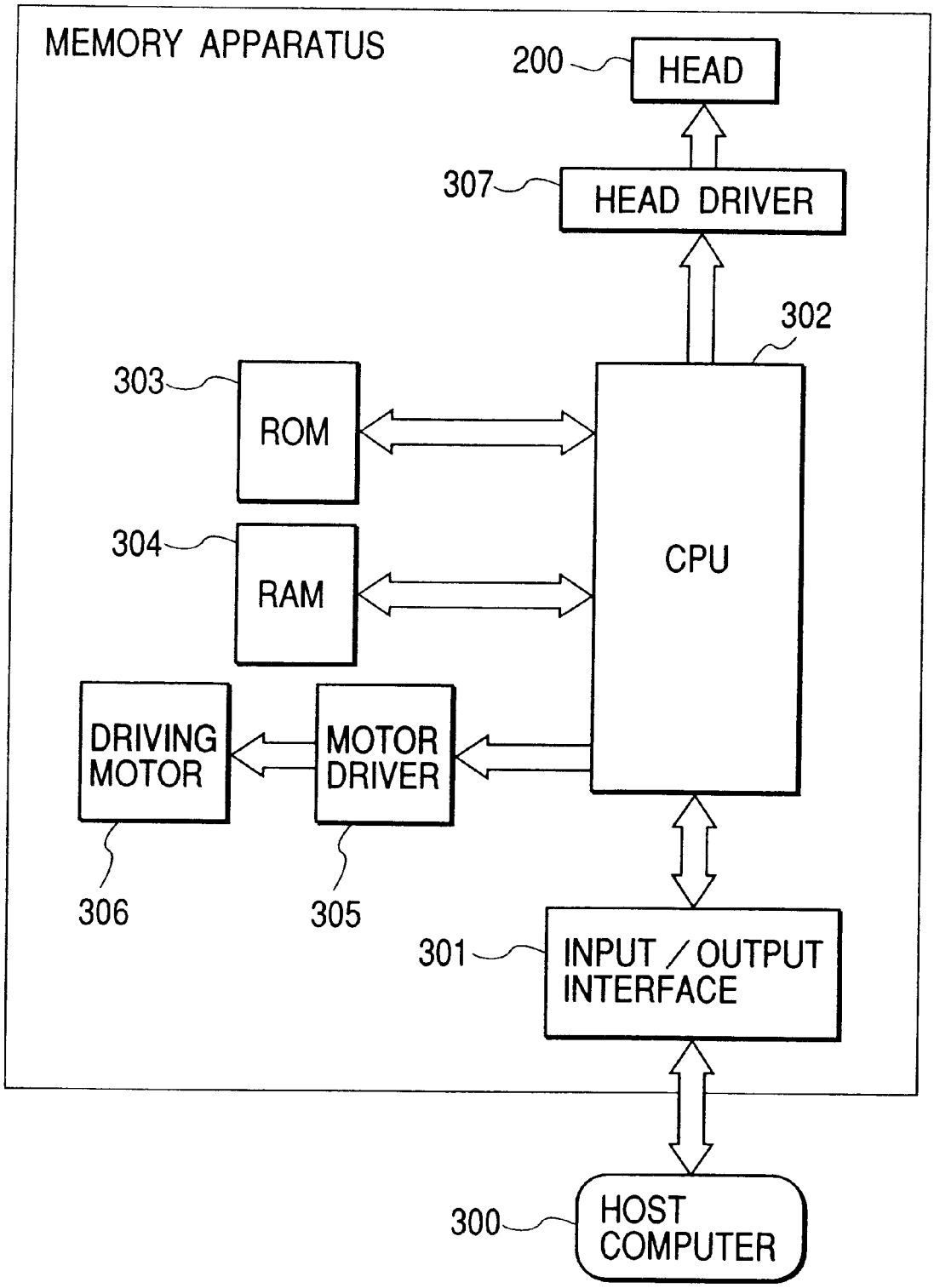
FIG. 20 is a block diagram showing the entire apparatus for performing liquid discharge recording in a liquid discharging method and the liquid discharge head according to the present invention.

FIG. 20 is a block diagram showing the entire recording apparatus for performing ink jet type recording using a liquid discharging apparatus according to the present invention.

The recording apparatus receives printing information from a host computer 300 as a control signal. The printing information is temporarily stored in an input interface 301 within a printing device, and is converted into data capable of being processed within the recording apparatus to be inputted into CPU (Central Processing Unit) 302 which serves dually as head driving signal supply means. The CPU 302 processes the data inputted in the CPU302 on the basis of a control program stored in a ROM (Read Only Memory) 303 using peripheral units such as a RAM (Random Access Memory) 304 to convert into data for printing (image data).

In order to record the image data on the recording sheet at an appropriate position, the CPU302 prepares driving data for driving the driving motor 306 for moving the carriage HC mounted with recording sheets and the recording head unit in synchronism with the image data. The image data and the motor driving data are transmitted to the recording head unit 200 and the driving motor 306 through a head driver 307 and a motor driver 305 respectively and are driven at respectively controlled timing to form an image.

As the recording medium 150 to be used for such a recording apparatus and to be given liquid such as ink, there can be used various sheets of paper or OHP sheets, plastic material to be used for compact disks, ornament plates or the like, cloth, metallic material such as aluminum and copper, leather material such as cowhide, pigskin and artificial leather, timber such as wood and plywood, bamboo material, ceramic material such as tiling, and three-dimensional configuration such as sponge.

As these recording apparatuses, there are included a printer apparatus for recording onto various types of sheets, OHP sheets or the like, a plastic recording apparatus for recording onto plastic material such as compact disks, a metal recording apparatus for recording onto a metal plate, a leather recording apparatus for recording onto leather, timber recording apparatus for recording onto timber, a ceramic recording apparatus for recording onto ceramic material, a recording apparatus for recording onto three-dimensional network configuration such as sponge, or a textile printing apparatus for recording onto cloth or the like.

As the discharging liquid to be used for these liquid discharging apparatus, liquid suitable for respective recording media and recording conditions can be used.

According to the present invention described above, the fluid flow in the vicinity of the discharge port accompanied by the growth of the bubble and start of bubble generation can be effectively utilized for formation of liquid droplets peculiar to ink jet, and the amount of backward movement of meniscus can be reduced. Therefore, time required for returning the meniscus can be greatly shortened, and dependence characteristic on response frequency can be improved.

Particularly, by means of the position of the liquid flow regulating portion relative to the movable member, the liquid flow toward the upstream side and growth of the bubble, which provides the refilling property with a minus effect, can be smoothly and quickly intercepted without bringing the movable member in the displacement process into contact, and the liquid flow path having the bubble generating area is made into substantially closed space, thus making it possible to effectively direct discharging energy caused by the growth of the bubble toward the discharge port.

What is claimed is:

1. A liquid discharging method through a liquid discharge head comprising:

a liquid flow path having a bubble generating area, in which a bubble is generated from liquid, a heater for generating heat energy to generate and grow said bubble, a discharge port which communicates with said liquid flow path and is a portion for discharging the liquid, a movable member provided in said bubble generating area, having a free end which shifts along with the growth of said bubble, and a liquid flow regulating portion for regulating a liquid flow in a direction opposite to said discharge port during a displacement process of said movable member and growth of said bubble, wherein said liquid flow regulating portion is located closer to a discharge port side of said liquid flow path than said free end of said movable member, wherein said liquid flow regulating portion hides said free end of said movable member in said displacement process, such that the liquid flow is regulated, and wherein said liquid flow regulating portion is kept at such a distance from said free end as not to bring it into contact with said free end, said method comprising a step of:

forming in said liquid flow path having said bubble generating area a space which is substantially closed except for said discharge port, by bringing said free end of said movable member, in the displacement process, close to said liquid flow regulating portion without having said free end and said liquid flow regulating portion substantially contact each other.

2. The liquid discharging method according to claim 1, wherein, in a process in which the free end of said movable member shifts, the liquid flow in a direction opposite to said discharge port is sheared when said free end is passing through the vicinity of said liquid flow regulating portion.

3. The liquid discharging method according to claim 2, having a process in which said bubble shrinks in a state where said closed space is formed.

4. The liquid discharging method according to claim 3, wherein, in the process in which said bubble shrinks, the greater part of the liquid which moves along with the shrinkage of said bubble is directed toward the upstream side from said discharge port and meniscus is suddenly drawn into said discharge port.

5. The liquid discharging method according to claim 4, wherein said movable member is spaced apart from said liquid flow regulating portion along with the shrinkage of said bubble, whereby a liquid flow toward the downstream side facing said discharge port is caused in said bubble generating area to thereby suddenly brake said meniscus to be drawn in.

6. A liquid discharge head comprising:

a liquid flow path having a bubble generating area, in which a bubble is generated from liquid;

a heater for generating heat energy to generate and grow said bubble;

a discharge port which communicates with said liquid flow path and is a portion for discharging the liquid;

a movable member provided in said bubble generating area, having a free end which shifts along with the growth of said bubble; and a liquid flow regulating portion for regulating a liquid flow in a direction opposite to said discharge port during a displacement process of said movable member and growth of said bubble, wherein said free end of said movable member and said liquid flow regulating portion are brought close to each other in the displacement process without substantially being brought into contact with each other, whereby said liquid flow path having said bubble generating area becomes a space substantially closed except for said discharge port, wherein said movable member and said liquid flow regulating portion are arranged such that the bubble at maximum growth does not intercept an interior of said space with reference to the fluid flow, wherein said liquid flow regulating portion is located closer to a discharge port side of said liquid flow path than said free end of said movable member, wherein said liquid flow regulating portion hides said free end of said movable member in said displacement process, such that the liquid flow is regulated, and wherein said liquid flow regulating portion is kept at such a distance from said free end as not to bring it into contact with said free end.

7. The liquid discharge head according to claim 6, wherein said liquid flow regulating portion is provided in the vicinity, on the discharge port side, of the displacement area of the free end of said movable member.

8. The liquid discharge head according to claim 6, wherein there is provided a displacement regulating unit for regulating displacement of said movable member after the formation of said closed space.

9. The liquid discharge head according to claim 6, wherein there is provided a side regulating unit, at least one portion of which substantially comes into contact with both side edges of said movable member in the displacement process, for regulating a bubble generated from said bubble generating area.

10. The liquid discharge head according to claim 6, wherein, in the process in which said free end of said movable member shifts, when said free end is passing through the vicinity of said liquid flow regulating portion, a space between said free end and said liquid flow regulating portion is made narrow.

11. The liquid discharge head according to claim 6, wherein an upstream-side portion of said liquid flow regulating portion has a tapered configuration which tapers downwards from a ceiling of said liquid flow path.

12. The liquid discharge head according to claim 6, wherein said movable member has a protruded portion which protrudes from the surface of said movable member on said heater side in the vicinity of said bubble generating area.

13. The liquid discharge head according to claim 6, wherein said heater and said discharge port are in a linearly-communicated state.

14. The liquid discharge head according to claim 6, wherein said movable member is provided to restrain only a bubble which grows toward the upstream side concerning a flow of liquid toward said discharge port.

15. The liquid discharge head according to claim 6, wherein said free end of said movable member is located in the substantially central portion of said bubble generating area.

16. The liquid discharge head according to claim 6, wherein flow path resistance of said liquid flow path when said movable member is in a stand-by state is lower on the upstream side than on the downstream side with said liquid flow regulating portion as the border.

17. The liquid discharge head according to claim 6, wherein said discharge port is provided to face to said heater.

18. The liquid discharge head according to claim 17, wherein a plurality of said movable members are formed for one heater, and said plurality of movable members are formed so as to be symmetrical with respect to a center of said heater.

19. A liquid discharging apparatus provided with a liquid discharge head according to any one of claims 6 to 9 and 10 to 18, and conveying means for conveying a recording medium for receiving liquid discharged from said liquid discharge head.

20. The liquid discharging apparatus according to claim 19, for discharging ink through said liquid discharge head to perform recording by causing said ink to adhere onto said recording medium.

* * * * *

UNITED STATES PATENT AND TRADEMARK OFFICE

CERTIFICATE OF CORRECTION

PATENT NO. : 6,533,401 B1 
DATED : March 18, 2003
INVENTOR(S) : Nobuyuki Matsumoto et al.

It is certified that error appears in the above-identified patent and that said Letters Patent is hereby corrected as shown below:

Column 11,
Line 50, "The flow of this" should read -- This --; and
Line 51, "after" should read -- after it --.

Column 12,
Lines 15, 17 and 18, "views" should read -- view --.

Column 13,
Lines 4, 6, 7, 37, 39 and 40, "views" should read -- view --.

Column 14,
Lines 5, 7, 8, 36, 38 and 39, "views" should read -- view --.

Column 15,
Lines 9, 11, 12, 51, 53 and 54, "views" should read -- view --.

Column 24,
Line 57, "to 9 and 10" should be deleted.

Signed and Sealed this

Twenty-eighth Day of October, 2003

JAMES E. ROGAN
*Director of the United States Patent and Trademark Office*